US007207396B2

(12) United States Patent
Hall et al.

(10) Patent No.: US 7,207,396 B2
(45) Date of Patent: Apr. 24, 2007

(54) METHOD AND APPARATUS OF ASSESSING DOWN-HOLE DRILLING CONDITIONS

(75) Inventors: David R. Hall, Provo, UT (US); David S. Pixton, Lehl, UT (US); Monte L. Johnson, Orem, UT (US); David B. Bartholomew, Springville, UT (US); Joe Fox, Spanish Fork, UT (US)

(73) Assignee: IntelliServ, Inc., Provo, UT (US)

( * ) Notice: Subject to any disclaimer, the term of this patent is extended or adjusted under 35 U.S.C. 154(b) by 257 days.

(21) Appl. No.: 10/878,243

(22) Filed: Jun. 28, 2004

(65) Prior Publication Data

US 2005/0284663 A1 Dec. 29, 2005

Related U.S. Application Data

(63) Continuation-in-part of application No. 10/605,373, filed on Sep. 25, 2003, and a continuation-in-part of application No. 10/315,263, filed on Dec. 10, 2002, and a continuation-in-part of application No. 10/613,549, filed on Jul. 2, 2003.

(60) Provisional application No. 60/481,225, filed on Aug. 13, 2003.

(51) Int. Cl.
*E21B 47/12* (2006.01)

(52) U.S. Cl. ..... 175/40; 340/853.3; 702/9

(58) Field of Classification Search ..... 175/24, 175/25, 38, 40, 48, 50; 340/853.3; 702/9
See application file for complete search history.

(56) References Cited

U.S. PATENT DOCUMENTS 2,414,719 A 1/1947 Cloud
3,518,608 A 6/1970 Papadopoulos
4,606,415 A 8/1986 Gray, Jr. et al.
4,739,325 A 4/1988 MacLeod
4,760,735 A * 8/1988 Sheppard et al. ..... 702/9
4,788,544 A 11/1988 Howard (Continued)

OTHER PUBLICATIONS

PCT/US03/16476, Published Dec. 4, 2003, Applicant Baker Hughes; International Search Report: "Documents Considered to Be Relevant".

*Primary Examiner*—Jennifer H. Gay
*Assistant Examiner*—Matthew J. Smith
(74) *Attorney, Agent, or Firm*—Tyson J. Wilde; Jeffery E. Daly

(57) ABSTRACT

A method and apparatus for use in assessing down-hole drilling conditions are disclosed. The apparatus includes a drill string, a plurality of sensors, a computing device, and a down-hole network. The sensors are distributed along the length of the drill string and are capable of sensing localized down-hole conditions while drilling. The computing device is coupled to at least one sensor of the plurality of sensors. The data is transmitted from the sensors to the computing device over the down-hole network. The computing device analyzes data output by the sensors and representative of the sensed localized conditions to assess the down-hole drilling conditions. The method includes sensing localized drilling conditions at a plurality of points distributed along the length of a drill string during drilling operations; transmitting data representative of the sensed localized conditions to a predetermined location; and analyzing the transmitted data to assess the down-hole drilling conditions.

33 Claims, 11 Drawing Sheets

U.S. PATENT DOCUMENTS 5,303,582 A 4/1994 Miska
5,358,058 A 10/1994 Edlund et al.
5,878,824 A 3/1999 Mercer et al.
6,012,015 A 1/2000 Tubel
6,252,518 B1 6/2001 Laborde
6,392,317 B1 5/2002 Hall et al.
6,401,838 B1 * 6/2002 Rezmer-Cooper ..... 175/38
6,670,880 B1 12/2003 Hall et al.
6,688,396 B2 2/2004 Floerke et al.
6,717,501 B2 4/2004 Hall et al.
6,799,632 B2 10/2004 Hall et al.
6,816,082 B1 * 11/2004 Laborde ..... 340/853.3
6,821,147 B1 11/2004 Hall et al.
6,830,467 B2 12/2004 Hall et al.
6,844,498 B2 1/2005 Hall et al.
6,866,306 B2 3/2005 Boyle et al.
6,868,920 B2 3/2005 Hoteit et al.
6,888,473 B1 5/2005 Hall et al.
6,913,093 B2 7/2005 Hall et al.
6,929,493 B2 8/2005 Hall et al.
6,944,547 B2 9/2005 Womer et al.
6,945,802 B2 9/2005 Hall et al.
2004/0039466 A1 2/2004 Lilly et al.
2004/0104797 A1 6/2004 Hall et al.
2004/0113808 A1 6/2004 Hall et al.
2004/0145492 A1 7/2004 Hall et al.
2004/0150532 A1 8/2004 Hall et al.
2004/0164833 A1 8/2004 Hall et al.
2004/0164838 A1 8/2004 Hall et al.
2004/0216847 A1 11/2004 Hall et al.
2004/0244916 A1 12/2004 Hall et al.
2004/0244964 A1 12/2004 Hall et al.
2004/0246142 A1 12/2004 Hall et al.
2005/0001735 A1 1/2005 Hall et al.
2005/0001736 A1 1/2005 Hall et al.
2005/0001738 A1 1/2005 Hall et al.
2005/0035875 A1 2/2005 Hall et al.
2005/0035876 A1 2/2005 Hall et al.
2005/0036507 A1 2/2005 Hall et al.
2005/0036874 A1 2/2005 Hall et al.
2005/0039912 A1 2/2005 Hall et al.
2005/0045339 A1 3/2005 Hall et al.
2005/0046586 A1 3/2005 Hall et al.
2005/0046590 A1 3/2005 Hall et al.
2005/0067159 A1 3/2005 Hall et al.
2005/0070144 A1 3/2005 Hall et al.
2005/0082082 A1 4/2005 Hall et al.
2005/0092499 A1 5/2005 Hall et al.
2005/0093296 A1 5/2005 Hall et al.
2005/0095827 A1 5/2005 Hall et al.
2005/0115717 A1 6/2005 Hall et al.
2005/0145406 A1 7/2005 Hall et al.
2005/0150653 A1 7/2005 Hall et al.
2005/0161215 A1 7/2005 Hall et al.
2005/0173128 A1 8/2005 Hall et al.
2005/0212530 A1 9/2005 Hall et al.
2005/0236160 A1 10/2005 Hall et al.

* cited by examiner

METHOD AND APPARATUS OF ASSESSING DOWN-HOLE DRILLING CONDITIONS

This is a continuation-in-part of the following co-pending, commonly assigned applications:

U.S. application Ser. No. 10/605,373, entitled "Load-Resistant Coaxial Transmission Line," and filed Sep. 25, 2003, in the name of David R. Hall, et al.;

U.S. application Ser. No. 10/315,263, entitled "Signal Connection for a Downhole Tool String (Swivel)", and filed Dec. 10, 2002, in the name of the inventors David R. Hall, et al.; and U.S. application Ser. No. 10/613,549, entitled "Link Module For a Downhole Drilling Network," and filed Jul. 2, 2003, in the name of David R. Hall, et al.

This Application also Claims Priority from the Following Provisional Application:

U.S. application Ser. No. 60/481,225, entitled "Downhole Network," and filed Aug. 13, 2003, in the name of David R. Hall, et al.

Each of these applications is hereby incorporated herein by reference for all purposes as if expressly set forth verbatim herein.

U.S. GOVERNMENT INTEREST

This invention was made with government support under Contract No. DE-FC26-01NT41229 awarded by the U.S. Department of Energy. The government has certain rights in the invention.

BACKGROUND OF THE INVENTION

1. Field of the Invention

The present invention pertains to drilling operations, and, more particularly, to the assessment of adverse down-hole drilling conditions.

2. Description of the Related Art

In many types of drilling operations, there is a great deal of interest in the drilling conditions encountered by the drilling equipment in the borehole. The reasons are many, but the interest primarily arises from the fact that even minor interruptions in drilling operations can be quite expensive. Many types of interruptions can be very expensive. Current economic conditions in the industry provide little margin for error with respect to costs. Thus, drilling companies have a strong incentive to avoid interruptions of any kind.

Gathering information about down-hole drilling conditions, however, can be a daunting challenge. The down-hole environment is very harsh, especially in terms of temperature, shock, and vibration. Furthermore, many drilling operations are conducted very deep within the earth, e.g., 20,000'–30,000', and the length of the drill string causes significant attenuation in the signal carrying the data to the surface. The difficulties of the down-hole environment also greatly hamper making and maintaining electrical connections down-hole, which impairs the ability to obtain large amounts of data down-hole and transmit it to the surface during drilling operations.

Approaches to these problems are few in terms of assessing adverse down-hole drilling conditions. Non-threatening condition may be recorded, displayed, or analyzed by a computing device as well. In general, data taken from the surface and only limited data taken from the surface and/or the bottom of the borehole is available. The drilling operators must extrapolate the down-hole drilling conditions from this data. Because the borehole might be as deep as 20,000'–30,000', surface data frequently is not particularly helpful in these types of extrapolations. The down-hole data can be more useful than surface data, but its utility is limited by its relatively small amount and the fact that it represents conditions localized at the bottom of the bore. Thus, the down-hole data may be useful in detecting some conditions at the bottom of the borehole but of little use for other conditions at the bottom or along the length of the drill string.

In downhole drilling applications, drilling fluids or drilling muds are circulated through the drill string and annulus of the borehole to remove cuttings from the borehole, lubricate and cool the drill bit, stabilize the borehole, control formation pore pressure, and the like, as a drill bit penetrates the earth. In conventional "overbalanced" drilling, the pressure of drilling fluids circulated through the drill string is typically maintained higher than the downhole formation's pore pressure. This provides a stabilizing function by keeping formation fluids, such as gas or other hydrocarbons, from overcoming the pressure of the drilling fluid, possibly causing a dangerous kick or blowout at the surface.

Although conventional overbalanced drilling has been recognized as the safest method of drilling, it has several drawbacks. Since the drilling fluid pressure is maintained higher than the formation's pore pressure, the formation is easily damaged by the intrusion of drilling fluids into the formation. For example, overbalanced drilling may cause the blockage or washout of the formation structure. In addition, because the drilling fluid pressure exceeds the formation's pore pressure, the penetration speed of the drill bit may actually decrease. This occurs because cuttings produced by the drill bit are often inadequately removed in overbalanced systems, thereby causing the drill bit to rotate against the buildup of cuttings rather than penetrating through virgin rock. This also decreases the life of the drill bit, thereby requiring more frequent drill bit replacement and loss of drilling time.

To overcome some of the disadvantages of "overbalanced" drilling, "underbalanced" drilling has been used and developed. In underbalanced drilling applications, the drilling fluid pressure is maintained below the formation pore pressure. In such applications, a well may actually flow while it is being drilled. Underbalanced drilling provides several significant advantages compared to overbalanced drilling.

For example, because the drilling fluid pressure is less than the formation pressure, the penetration of drilling fluid into the formation is reduced, thereby reducing damage to the well. Since formation damage is reduced, stimulation needed to initiate well production is also lessened. Moreover, drilling penetration rates may increase significantly because the higher formation pore pressure may naturally urge cuttings away from the cutting surface as they are removed by the drill bit. Thus, better contact is provided between the drill bit and virgin rock. Also, since filter caking (i.e. caking around the well bore caused by the penetration of drilling fluids into the formation) is reduced, sticking between the drill sting and the borehole is also reduced. Perhaps even more importantly, the decreased drilling fluid pressure in underbalanced applications can help detect potential sources of hydrocarbons that may go undetected using convention drilling techniques.

Nevertheless, underbalanced drilling also presents certain challenges. First, underbalanced drilling is more subject to blowouts, fires, and explosions caused by the formation pore pressure overwhelming the lower pressure of the drilling fluid. Second, due to the precise control and monitoring needed, underbalanced drilling can be more expensive than conventional drilling. Also, because of the decreased pressure, the removal of cuttings can be problematic, especially in directional drilling applications where the well deviates from vertical or is substantially horizontal.

For instance, one adverse drilling condition of interest is "stuck pipe." As the drill sting bores through the earth, the borehole seldom descends straight into the earth. There typically are many deviations from the vertical, and some may be very severe in some drilling applications. In these situations, the sides of the borehole may bind the drill string causing it to become stuck within the borehole. Once the drill string becomes stuck, it is quite costly to halt drilling operations and free the drill string.

Currently, stuck pipe is quite easy to detect at the surface once it occurs. Early indications that a stuck pipe condition is developing may be garnered from torque measurements made at the top of the drill string, i.e., at the surface. However, there is value in knowing not only that a stuck pipe condition is developing, but where in the borehole it is occurring. Current techniques cannot provide this kind of information because the data they work from has insufficient granularity.

The present invention is directed to resolving, or at least reducing, one or all of the problems mentioned above.

SUMMARY OF THE INVENTION

The present invention comprises a method and apparatus for use in adverse down-hole drilling conditions. The apparatus comprises a drill string, a plurality of sensors, a computing device; and a down-hole network. The sensors are distributed along the length of the drill string and are capable of sensing localized down-hole conditions while drilling. The data is transmitted from the sensors to the computing device over the down-hole network. The computing device analyzes data output by the sensors and representative of the sensed localized conditions to assess the down-hole drilling conditions. The method comprises sensing localized drilling conditions at a plurality of points distributed along the length of a drill string during drilling operations; transmitting data representative of the sensed localized conditions to a predetermined location; and analyzing the transmitted data to assess the down-hole drilling conditions.

BRIEF DESCRIPTION OF THE DRAWINGS

The invention may be understood by reference to the following description taken in conjunction with the accompanying drawings, in which like reference numerals identify like elements, and in which.

While the invention is susceptible to various modifications and alternative forms, the drawings illustrate specific embodiments herein described in detail by way of example. It should be understood, however, that the description herein of specific embodiments is not intended to limit the invention to the particular forms disclosed, but on the contrary, the intention is to cover all modifications, equivalents, and alternatives falling within the spirit and scope of the invention as defined by the appended claims.

DETAILED DESCRIPTION OF THE INVENTION

Illustrative embodiments of the invention are described below. In the interest of clarity, not all features of an actual implementation are described in this specification. It will of course be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort, even if complex and time-consuming, would be a routine undertaking for those of ordinary skill in the art having the benefit of this disclosure.

The invention comprises an apparatus and a method for use in assessing adverse, down-hole drilling conditions. In general, the apparatus comprises:

- a drill string (shown best in FIG. 1);
- a plurality of sensors (shown best in FIG. 5) distributed along the length of the drill string and capable of sensing localized down-hole conditions while drilling;
- a computing device (shown best in FIG. 14) capable of analyzing data output by the sensors and representative of the sensed localized conditions to assess the down-hole drilling conditions; and a down-hole network (shown best in FIG. 2) over which the data may be transmitted from the sensors to the computing device.

Figure 15:
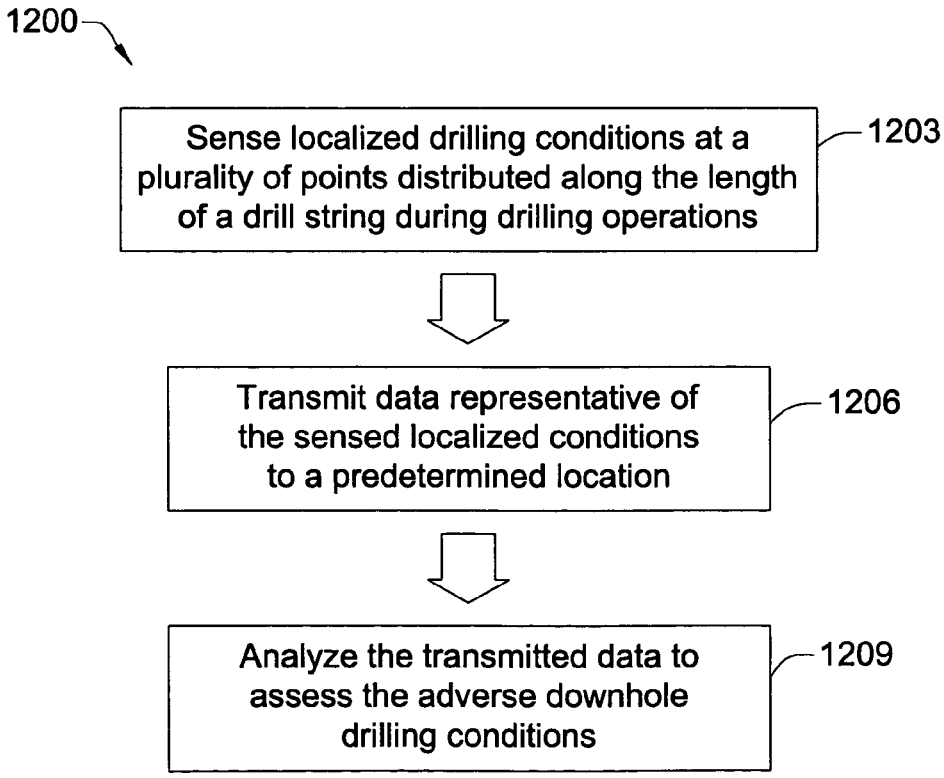
FIG. 15 is a flow diagram illustrating an embodiment of the method for use in assessing down-hole drilling conditions.

In general, the method comprises, as shown in FIG. 15:

sensing localized drilling conditions at a plurality of points distributed along the length of a drill string during drilling operations;

transmitting data representative of the sensed localized conditions to a predetermined location; and analyzing the transmitted data to assess the down-hole drilling conditions.

One particular embodiment of the apparatus and method of the present invention is disclosed in turn in more detail below.

Figure 1:
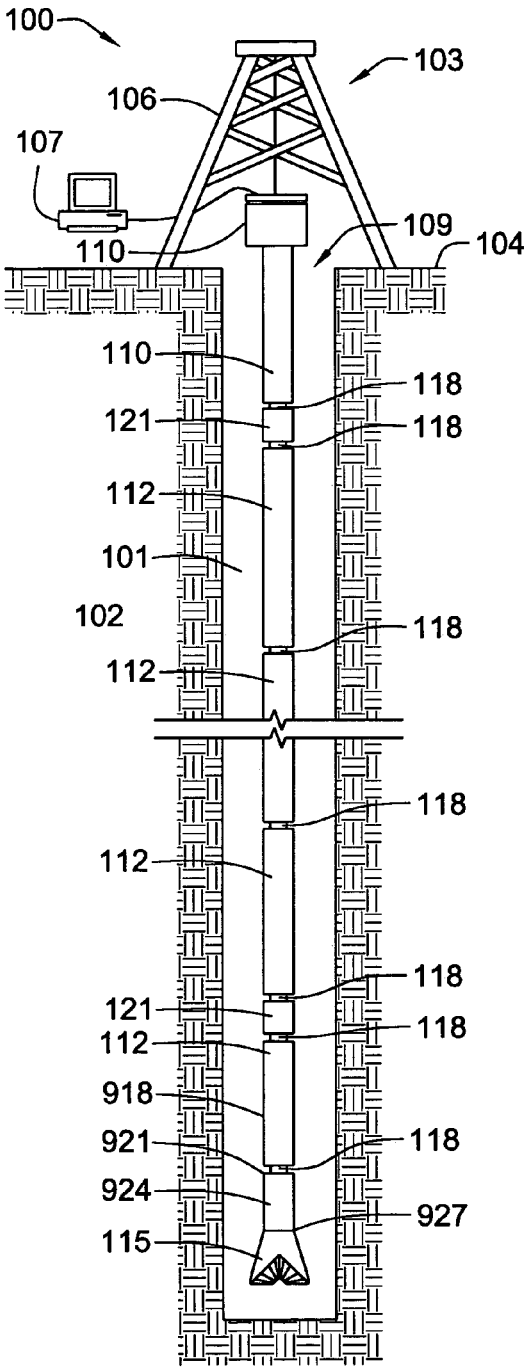
FIG. 1 is a profile view of a drilling operation using an apparatus and method in accordance with the invention.

FIG. 1 illustrates a drilling operation 100 in which a borehole 101 is being drilled in the ground 102 beneath the surface 104 thereof. The drilling operation includes a drilling rig 103 (e.g., a derrick 106, a drill string 109) and a computing apparatus 107. The drill string 109 comprises a kelly 110 and multiple sections 112 of drill pipe and other down-hole tools mated to create joints 118, 927 between the sections 112. A bottom-hole assembly 115, connected to the bottom of the drill string 109, may include a drill bit, sensors, and other down-hole tools.

The drill string 109 includes, in the illustrated embodiment, a plurality of network nodes 121 that are inserted at desired intervals along the drill string 109, such as every 1,000 to 5,000 feet, to perform various functions. For example, the network nodes 121 may function as signal repeaters to regenerate data signals and mitigate signal attenuation resulting from transmission up and down the drill string 109. These nodes 121 may be integrated into an existing section 112 of drill pipe or a down-hole tool or stand alone, as in the embodiment of FIG. 1.

Figure 2:
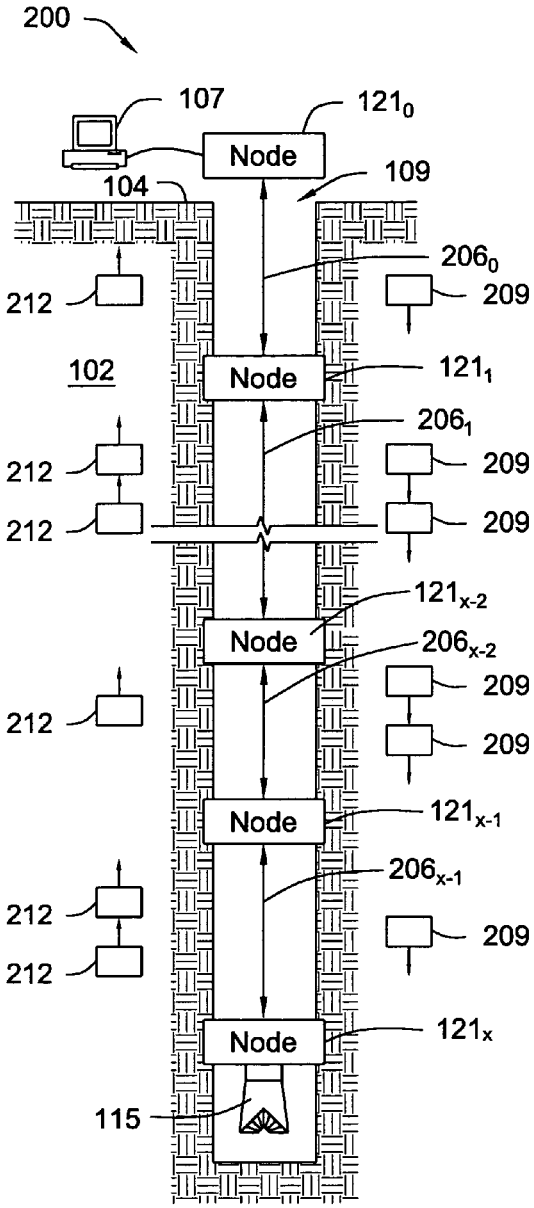
FIG. 2 is a profile view illustrating a down-hole network implemented in the drilling operation of FIG. 1.

As illustrated in FIG. 2, the nodes 121 (i.e., the nodes $\mathbf{121}_0$–$\mathbf{121}_x$) comprise a portion of a down-hole network 200 used to transmit information along the drill string 109. The nodes 121 may be intelligent computing devices, or may be less intelligent connection devices, such as hubs or switches located along the length of the network 200. Each of the nodes 121 may or may not be addressed on the network 200. The down-hole network 200 may include multiple nodes 121 spaced up and down a drill string 109. Note that the number of nodes 121 is not material to the practice of the invention and will be an implementation specific detail. The nodes 121 in the illustrated embodiment also function as signal repeaters, as is described more fully below, and so are spaced every 1,000' or so. Thus, in the illustrated embodiment, the number of nodes 121 is a function of the overall length of the drill string 109.

The bottom-hole node $\mathbf{121}_x$ interfaces with the bottom-hole assembly 115 located at the end of the drill string 109. Other, intermediate, nodes $\mathbf{121}_1$–$\mathbf{121}_{x-1}$ may be located or spaced apart along the length of the drill string 109 to act as relay points for signals traveling along the down-hole network 200 and to interface with various tools or sensors (not shown in FIG. 2) located along the length of the drill string 109. Likewise, the top-hole node $\mathbf{121}_0$ may be located at the top or proximate the top of the drill string 109 to interface with the computing apparatus 107. The computing apparatus 107 captures, stores, and analyzes the data collected down-hole during drilling in order to assess down-hole drilling conditions.

Communication links $\mathbf{206}_0$–$\mathbf{206}_{x-1}$ may be used to connect the nodes $\mathbf{121}_0$–$\mathbf{121}_x$ to one another. The communication links $\mathbf{206}_0$–$\mathbf{206}_{x-1}$ may be comprised of cables or other transmission media integrated directly into sections 112 of the drill string 109, routed through the central borehole of a drill string, or routed externally to the drill string. Alternatively, in certain contemplated embodiments in accordance with the invention not shown, the communication links $\mathbf{206}_0$–$\mathbf{206}_{x-1}$ may be wireless connections. In the illustrated embodiment, the down-hole network 200 comprises a packet-switched or circuit-switched network 200.

As in most networks, a plurality of packets 209, 212 are used to transmit information among the nodes $\mathbf{121}_0$–$\mathbf{121}_x$. The packets 212 may be used to carry data from tools or sensors, located down-hole, to an up-hole node $\mathbf{121}_0$, or may carry information or data necessary to the functioning of the network 200. Likewise, selected packets 209 may be transmitted from up-hole nodes $\mathbf{121}_0$ to down-hole nodes $\mathbf{121}_1$–$\mathbf{121}_x$. These packets 209, for example, may be used to send control signals from a top-hole node $\mathbf{121}_x$ to tools or sensors located in or proximate various down-hole nodes $\mathbf{121}_1$–$\mathbf{121}_x$. Thus, a down-hole network 200 provides an effective means for transmitting data and information between components located down-hole on a drill string 109, and devices located at or near the surface 104 of the earth 102.

To accommodate the transmission of the anticipated volume of data, the drill string 109 will transmit data at a rate of at least 100 bits/second, and on up to at least 1,000,000 bits/second. However, signal attenuation is a concern. A typical length for a section 112 of pipe is 30'–120'. Drill strings in oil and gas production can extend as long as 20,000'–30,000', or longer, which means that as many as 700 sections of drill pipe, down hole tools, collars, subs, etc. can found in a drill string such as the drill string 109. The transmission line created through the drill string 109 (described below) will typically transmit the information signal a distance of 1,000 to 2,000 feet before the signal is attenuated to the point where amplification will be desirable. Thus, amplifiers, or "repeaters," are provided for approximately some of the components in the drill string 109, for example, 5% of components not to exceed 10%, in the illustrated embodiment. In the illustrated embodiment, the repeaters are housed in the nodes 121, as will be described more fully below, although this may not be required to the practice of the invention.

Figure 3:
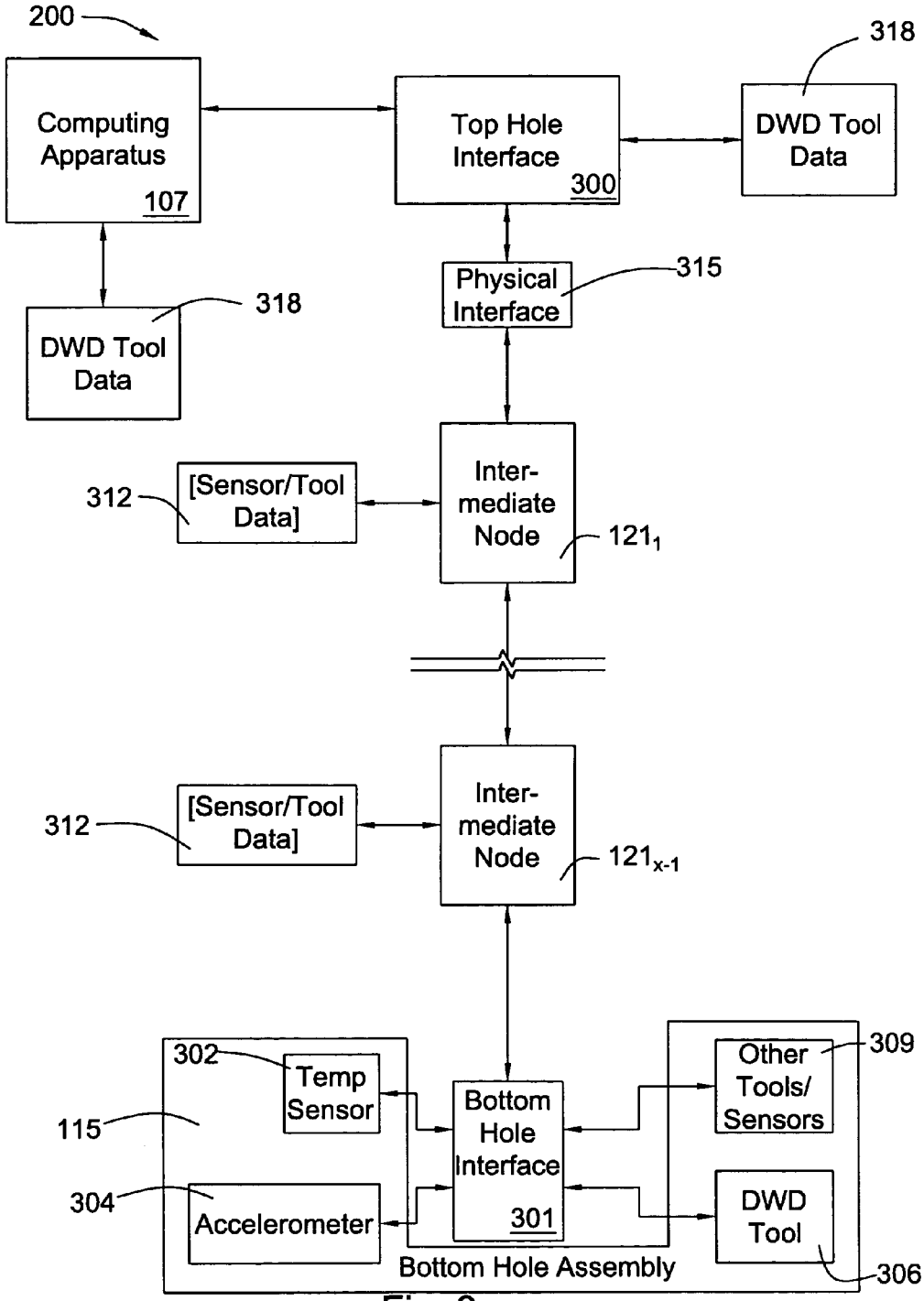
FIG. 3 is a schematic block diagram illustrating a high-level functionality of one embodiment of the down-hole network of FIG. 2.

Still referring to FIG. 2, the down-hole network 200 includes a top-hole node $\mathbf{121}_0$ and a bottom-hole node $\mathbf{121}_x$ that implement, as shown in FIG. 3, a top-hole interface 300 and a bottom-hole interface 301, respectively. The bottom-hole interface 301 interfaces to various components located in or proximate the bottom-hole assembly 1 5. For example, in the illustrated embodiment, the bottom-hole interface 301 interfaces with a temperature sensor 302, an accelerometer 304, a DWD (diagnostic-while-drilling) tool 306, or other tools or sensors 309, as needed.

The bottom-hole interface 301 also communicates with the intermediate node $\mathbf{121}_{x-1}$ located up the drill string. The intermediate node $\mathbf{121}_{x-1}$ also interfaces with or receives tool or sensor data 312 for transmission up or down the network 200. Likewise, other nodes 121 such as a second intermediate node $\mathbf{121}_1$ may be located along the drill string and interface with other sensors or tools to gather data 312 therefrom. Any number of intermediate nodes 121 may be used along the network 200 between the top-hole interface 300 and the bottom-hole interface 301.

A physical interface 315 may be provided to connect network components to a drill string 109. For example, since data is transmitted directly up the drill string on cables or other transmission media integrated directly into drill pipe or other drill string components, the physical interface 315 provides a physical connection to the drill string so data may be routed off of the drill string 109 to network components, such as a top-hole interface 300, or the computing apparatus 107, shown in FIG. 2. One particular implementation employs a swivel disclosed more fully in U.S. application Ser. No. 10/315,263, entitled "Signal Connection for a Downhole Tool String (Swivel)", and filed Dec. 10, 2002, in the name of the inventors David R. Hall, et al.

For example, a top-hole interface 300 may be operably connected to the physical interface 315. The top-hole interface 300 may be connected to an analysis device, such as the computing apparatus 107. The computing apparatus 107 analyzes or examines data gathered from various down-hole tools or sensors, e.g., the data 312. Likewise, DWD tool data 318, originally collected by the DWD tool 306 of the bottom-hole assembly 115, may be saved or output from the computing apparatus 107. Likewise, in other embodiments, DWD tool data 318 may be extracted directly from the top-hole interface 300 for analysis.

Figure 4:
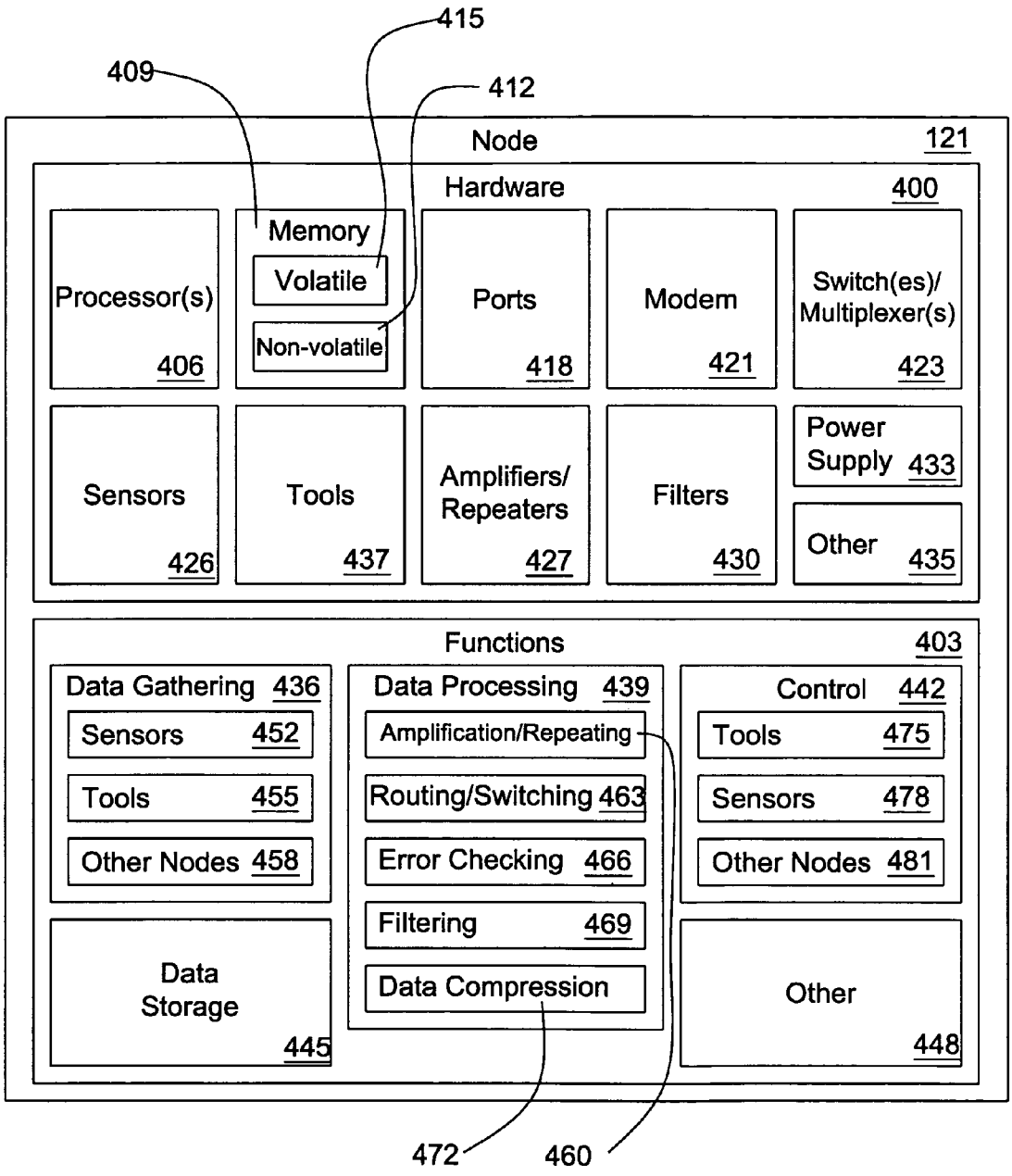
FIG. 4 is a schematic block diagram illustrating one embodiment of a node used to implement the down-hole network of FIG. 2, including various devices, sensors, and tools in accordance with one particular embodiment of the present invention.

Referring to FIG. 4, each network node 121 in the illustrated embodiment includes hardware 400 providing functionality to the node 121 represented by the functions 403 performed by the node 121. The functions 403 may be provided strictly by the hardware 400, by software applications executable on the hardware 400, or a combination thereof. For example, the hardware 400 may include one or several processors 406 capable of processing or executing instructions or other data. The processors 406 may include hardware such as busses, clocks, cache, or other supporting hardware.

The hardware 400 includes memory 409, both volatile memory 412 and/or non-volatile memory 415, providing data storage and staging areas for data transmitted between hardware components 400. Volatile memory 412 may include random access memory ("RAM") or equivalents thereof, providing high-speed memory storage. Memory 409 may also include selected types of non-volatile memory 415 such as read-only-memory ("ROM"), or other long term storage devices, such as hard drives and the like. The non-volatile memory 412 stores data such as configuration settings, node addresses, system settings, and the like. Ports 418, such as serial, parallel, or other ports, may be used to input and output signals up-hole or down-hole from the node 121, provide interfaces with sensors 426 or tools 437 located proximate the node 121, or interface with other tools 437 or sensors located in a drilling environment.

A modem 421 modulates digital data onto a carrier signal for transmission up-hole or down-hole along the network 200. Likewise, the modem 421 demodulates digital data from signals transmitted along the network 200. A modem 421 may provide various built in features including but not limited to error checking, data compression, or the like. In addition, the modem 421 may use any suitable modulation type such as QPSK, OOK, PCM, FSK, QAM, or the like. The choice of a modulation type may depend on a desired data transmission speed, as well as unique operating conditions that may exist in a down-hole environment. Likewise, the modem 421 may be configured to operate in full duplex, half duplex, or other mode. The modem 421 may also use any of numerous networking protocols currently available, such as collision-based protocols, such as Ethernet, or token-based protocols such as are used in token ring networks.

The node 121 may also includes one or several switches or multiplexers 423 to filter and forward packets between nodes 121 of the network 200, or combine several signals for transmission over a single medium. Likewise, a demultiplexer (not shown) may be included with the multiplexer 423 to separate multiplexed signals received on a transmission line. Alternately, a node 121 may not require switches or multiplexers 423 at all, as a single bus may provide the same information to all nodes 121 simultaneously. In other embodiments, a node 121 may comprise multiple modems 421. A packet may be received by the node 121 through one modem 421 and transmit it to another node 121 by another modem 421, without need of switches.

The node 121 also includes various sensors 426 located within the node 121 or interfacing with the node 121. Sensors 426 may include data gathering devices such as pressure sensors, inclinometers, temperature sensors, thermocouplers, accelerometers, imaging devices, seismic devices, strain gauges, or the like. The sensors 426 may be configured to gather data for transmission up the network 200 to the ground's surface 104, or may also receive control signals from the surface 104 to control selected parameters of the sensors 426. For example, an operator at the surface 104 may actually instruct a sensor 426 to take a particular measurement. Likewise, other tools 437 located down-hole may interface with a node 121 to gather data for transmission up-hole, or follow instructions received from the surface 104.

Since the drill string 109 may extend into the earth 20,000 feet or more, signal loss or signal attenuation that occurs when transmitting data along the down-hole network 200 is a consideration. Various hardware or other devices of the down-hole network 200 may be responsible for causing different amounts of signal attenuation. For example, since the drill string 109 is typically comprised of multiple sections 112 of drill pipe or other drill tools, signal loss may occur each time a signal is transmitted from one section 112 to another. Since the drill string 109 may include several hundred sections 112 of drill pipe or other tools, the total signal loss that occurs across all of the tool joints 118 may be quite significant. Moreover, a certain level of signal loss may occur in the cable or other transmission media (e.g., the communications links $\mathbf{206}_0$–$\mathbf{206}_{x-1}$) extending from the bottom-hole assembly 115 to the surface 104.

To reduce data loss due to signal attenuation, amplifiers or repeaters 472, housed in the nodes 121 in the illustrated embodiment, are spaced at various intervals along the down-hole network 200. Amplifiers receive a data signal, amplify it, and transmit it to the next node 121. Like an amplifier, a repeater receives a data signal and retransmits it at a higher power. However, unlike an amplifier, a repeater may remove noise from the data signal and, in some embodiments, check for and remove errors from the data stream. The illustrated embodiment employs repeaters, rather than amplifiers. Although the amplifiers/repeaters 472 are shown comprising a portion of the node 121 in FIG. 4, such is not necessary to the practice of the invention. One suitable, stand alone repeater unit is disclosed in U.S. application Ser. No. 10/613,549, entitled "Link Module For a Downhole Drilling Network," and filed Jul. 2, 2003, in the name of David R. Hall, et al.

Still referring to FIG. 4, the node 121 may also include various filters 430. Filters 430 may be used to filter out undesired noise, frequencies, and the like that may be present or introduced into a data signal traveling up or down the network 200. Likewise, the node 121 may include a power supply 433 to supply power to any or all of the hardware 400. The node 121 may also include other hardware 435, as needed, to provide desired functionality to the node 121.

The node 121 provides various functions 403 that are implemented by software, hardware, or a combination thereof. For example, the functions 403 of the node 121 may include data gathering 436, data processing 439, control 442, data storage 445, and other functions 448. Data may be gathered from sensors 452 located down-hole, tools 455, or other nodes 458 in communication with a selected node 121. This data 436 may be transmitted or encapsulated within data packets (e.g., the packets 206, 209, shown in FIG. 2) transmitted up and down the network 200.

Likewise, the node 121 may provide various data processing functions 439. For example, data processing may include data amplification or repeating 460, routing or switching 463 data packets transmitted along the network 200, error checking 466 of data packets transmitted along the network 200, filtering 469 of data, as well as data compression or decompression 472. Likewise, a node 121 may process various control signals 442 transmitted from the surface 104 to the tools 475, sensors 478, or other nodes 481 located down-hole. Likewise, a node 121 may store data that has been gathered from tools, sensors, or other nodes 121 within the network 200. Likewise, the node 121 may include other functions 448, as needed.

Figure 5:
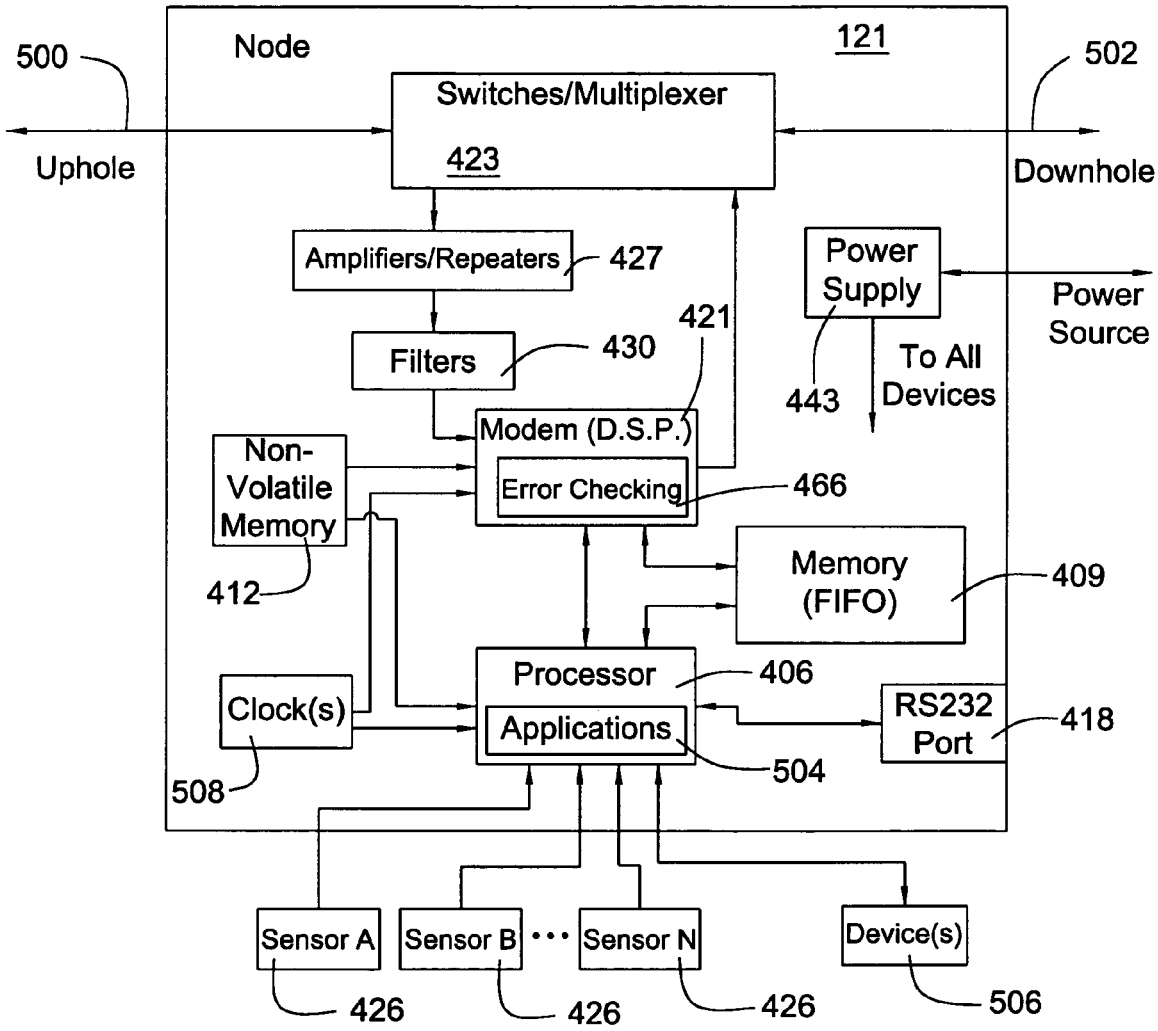
FIG. 5 is a schematic block diagram illustrating certain relationships among various hardware and corresponding functions provided by a node such as the node in FIG. 4.

FIG. 5 illustrates one particular implementation of the node 121 shown in FIG. 4. The switches and/or multiplexers 423 receive, switch, and multiplex or demultiplex signals, received from other, up-hole and/or down-hole nodes 121 over the lines 500, 502, respectively. The switches/multiplexers 423 direct traffic such as data packets or other signals into and out of the node 121, and ensure that the packets or signals are transmitted at proper time intervals, frequencies, or a combination thereof.

In certain embodiments, the multiplexer 423 may transmit several signals simultaneously on different carrier frequencies. In other embodiments, the multiplexer 423 may coordinate the time-division multiplexing of several signals. Signals or packets received by the switch/multiplexer 423 are amplified by the amplifiers/repeaters 427 and filtered by the filters 430, such as to remove noise. In other embodiments, the signals may be received, data may be demodulated therefrom and stored, and the data may be remodulated and retransmitted on a selected carrier frequency having greater signal strength. The modem 421 may be used to demodulate analog signals received from the switch/multiplexer into digital data and modulate digital data onto carriers for transfer to the switches/multiplexer where they may be transmitted up-hole or down-hole.

The processor 406 executes one or more applications 504. One of the applications 504 acquires data from one or a plurality of sensors 426*a–c*. For example, the processor 406 may interface to sensors 426 such as inclinometers, thermocouplers, accelerometers, imaging devices, seismic data gathering devices, or other sensors. Thus, the node 121 functions as a data acquisition tool in the illustrated embodiment. In some embodiments, the processor 406 may also run applications 504 that may control various devices 506 located down-hole. That is, not only may the node 121 be used as a repeater, and as a data gathering device, but may also be used to receive or provide control signals to control selected devices as needed. The node 121 may include a memory device 409 implementing a data structure, such as a first-in, first out ("FIFO") queue, that may be used to store data needed by or transferred between the modem 421 and the processor 406. One or several clocks 508 may be provided to provide clock signals to the modem 421, the processor 406, or other electronic device in the node 121.

In general, the node 121 may be housed in a module (not otherwise shown) having a cylindrical or polygonal housing defining a central bore. Size limitations on the electronic components of the node 121 may restrict the diameter of the borehole to slightly smaller than the inner borehole diameter of a typical section of drill pipe 112. The module is configured for insertion into a host down-hole tool and may be removed or inserted as needed to access or service components located therein. In one particular embodiment, at least some of the electronic components are mounted in sealed recesses on the external surface of the housing and channels are milled into the body of the module for routing electrical connections between the electronic components.

Figure 6:
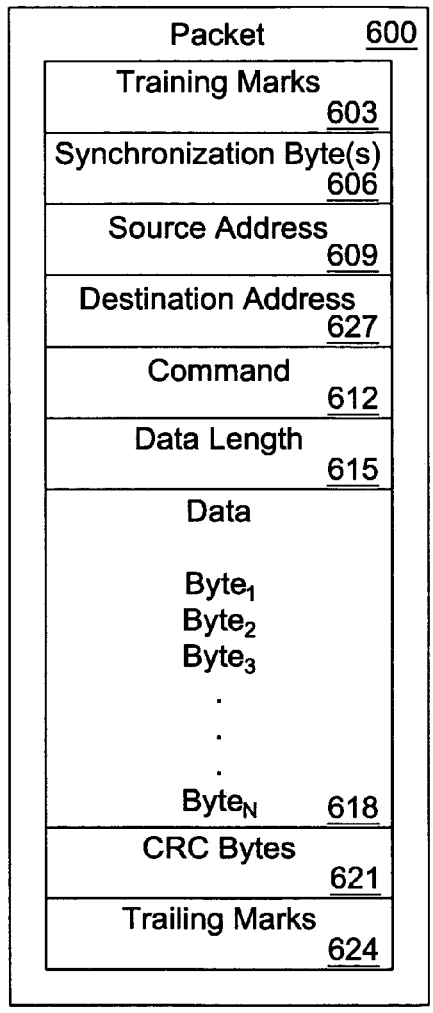
FIG. 6 is a schematic block diagram illustrating one embodiment of a packet used to transmit data between nodes.

FIG. 6 illustrates an exemplary embodiment of a packet 600 whose structure may be used to implement the packets 209, 212 in FIG. 2. The packet 600 contains data, control signals, network protocols, and the like may be transmitted up and down the drill string. For example, in one embodiment, a packet 600 in accordance with the invention may include training marks 603. Training marks 603 may include any overhead, synchronization, or other data needed to enable another node 121 to receive a particular data packet 600.

Likewise, a packet 600 may include one or several synchronization bytes 606. The synchronization byte 606 or bytes may be used to synchronize the timing of a node 121 receiving a packet 600. Likewise, a packet 600 may include a source address 609, identifying the logical or physical address of a transmitting device, and a destination address 627, identifying the logical or physical address of a destination node 121 on a network 200.

A packet 600 may also include a command byte 612 or bytes 612 to provide various commands to nodes 121 within the network 200. For example, the command bytes 612 may include commands to set selected parameters, reset registers or other devices, read particular registers, transfer data between registers, put devices in particular modes, acquire status of devices, perform various requests, and the like.

Similarly, a packet 600 may include data or information 615 with respect to the length of data 618 transmitted within the packet 600. For example, the data length 615 may be the number of bits or bytes of data carried within the packet 600. The packet 600 may then include data 618 comprising a number of bytes. The data 618 may include data gathered from various sensors or tools located down-hole, or may contain control data to control various tools or devices located down-hole. Likewise one or several CRC bytes 621 may be used to perform error checking of other data or bytes within a packet 600. Trailing marks 624 may trail other data of a packet 600 and provide any other overhead or synchronization needed after transmitting a packet 600. One of ordinary skill in the art will recognize that network packets 600 may take many forms and contain varied information. Thus, the example presented herein simply represents one contemplated embodiment in accordance with the invention, and is not intended to limit the scope of the invention.

Figure 7:
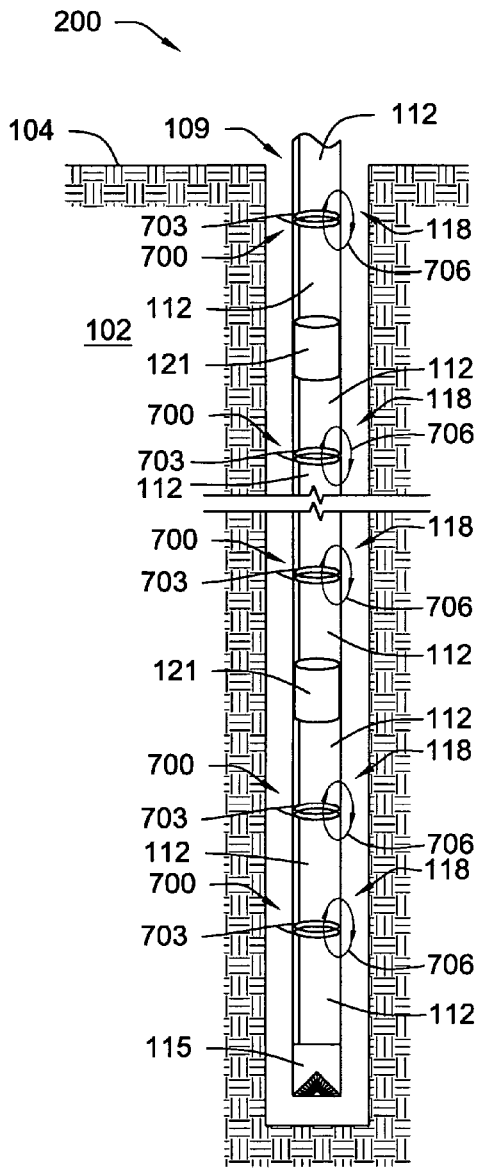
FIG. 7 is a partial profile view of the drilling operation of FIG. 1 illustrating the transmission path through the drill string employed by the down-hole network of FIG. 2.

Referring now to FIG. 7, in the illustrated embodiment, the down-hole network 200 includes various nodes 121, as described above, spaced at selected intervals along the network 200. Each of the nodes 121 is in operable communication with the bottom-hole assembly 115. As data signals or packets 209, 212 (shown in FIG. 2) travel up and down the network 200, transmission elements 700 are used to transmit signals across tool joints 118 between sections 112 of the drill string 109.

As illustrated, in selected embodiments, the transmission elements 700, e.g., two inductive coils 703, are used to transmit data signals across tool joints 118. A first inductive coil 703 converts an electrical data signal to a magnetic field. A second inductive coil 703 detects the magnetic field and converts the magnetic field back to an electrical signal, thereby providing signal coupling across a tool joint 118. Thus, a direct electrical contact is not needed across a tool joint 118 to provide effective signal coupling, as indicated by the loops 706. Nevertheless, in other embodiments, direct electrical contacts may be used to transmit electrical signals across tool joints 118. When using inductive coils 703, however, consistent spacing should be provided between each pair inductive coils 703 to provide consistent impedance or matching across each tool joint 118 to help prevent excessive signal loss caused by signal reflections or signal dispersion at the tool joint 118.

Figure 8A:
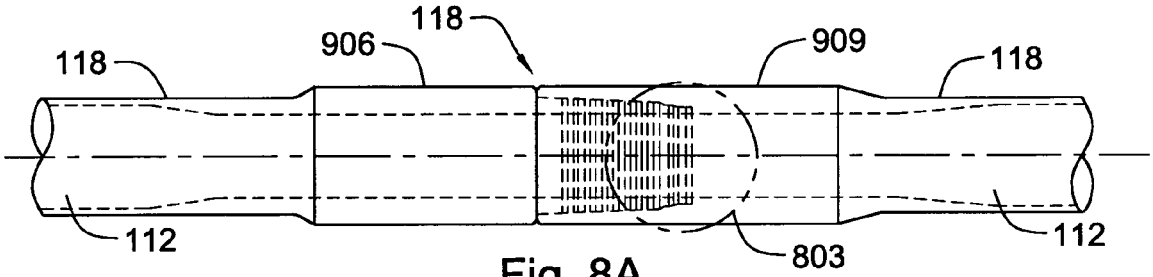
FIG. 8A–FIG. 8B depict an exemplary joint in the drill string of FIG. 1.
Figure 8B:
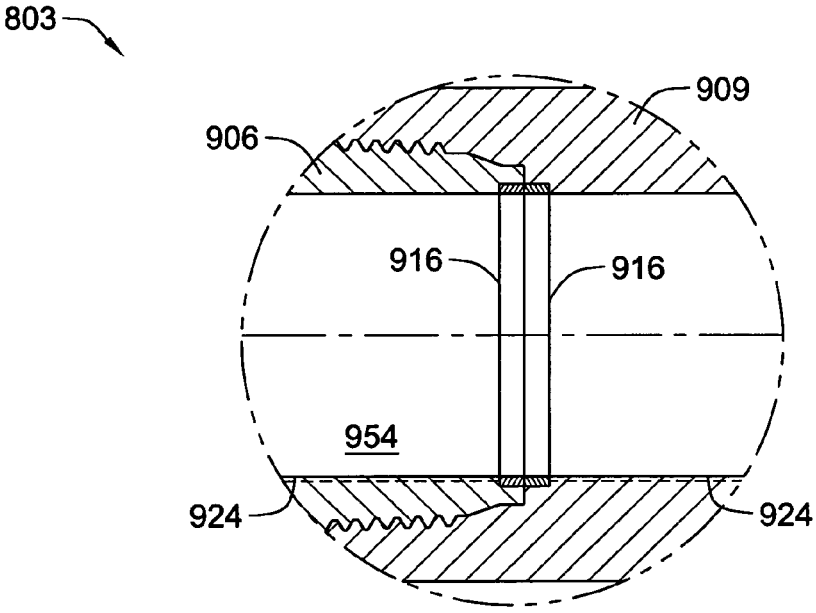
Figure 9A:
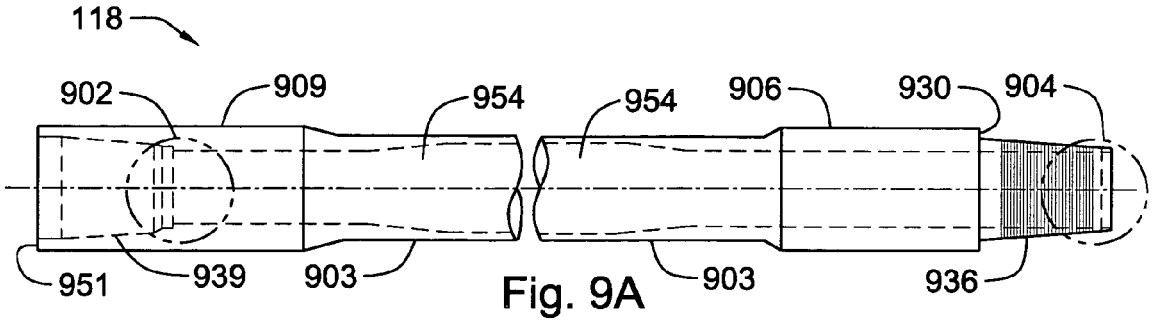
FIG. 9A–FIG. 9C illustrate one section of pipe, two of which are mated to form the joint of FIG. 8A–FIG. 8B.
Figure 9B:
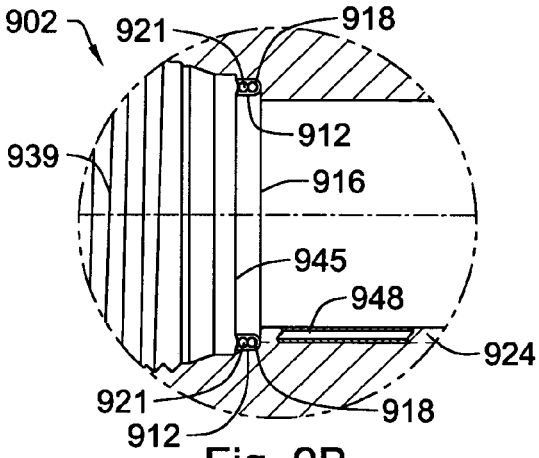
Figure 9C:
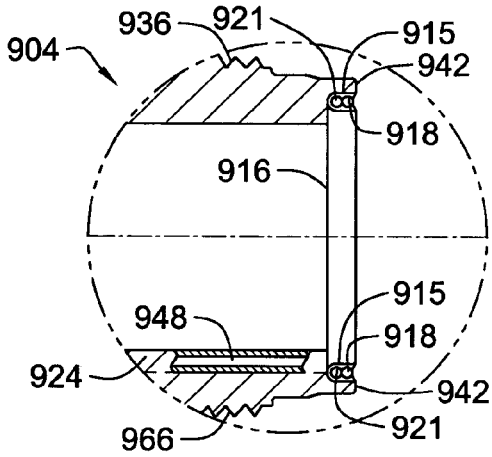

FIG. 8A is an enlarged view of the made up joint 118 of FIG. 1. The two individual sections 112 are best shown in FIG. 9A–FIG. 9C. FIG. 8B is an enlarged view of a portion 803 of the view in FIG. 8A of the joint 118. FIG. 9B–FIG. 9C are enlarged views of a portion 902 of a box end 909 and a portion 904 of the pin end 906 of the section 112 as shown in FIG. 9A As will be discussed further below, each section 112 includes a transmission path that, when the two sections 112 are mated as shown in FIG. 8A, aligns. When energized, the two transmission paths electromagnetically couple across the joint 118 to create a single transmission path through the drill string 109. Various aspects of the particular transmission path of the illustrated embodiment are more particularly disclosed and claimed in the aforementioned U.S. Pat. No. 6,670,880. However, the present invention may be employed with other types of drill pipe and transmission systems.

Turning now to FIG. 9A, each section 112 includes a tube body 903 welded to an externally threaded pin end 906 and an internally threaded box end 909. Pin and box end designs for sections of drill pipe are well known to the art, and any suitable design may be used. Acceptable designs include those disclosed and claimed in:

- U.S. Pat. No. 5,908,212, entitled "Ultra High Torque Double Shoulder Tool Joint", and issued Jun. 1, 1999, to Grant Prideco, Inc. of The Woodlands, Tex., as assignee of the inventors Smith, et al.; and
- U.S. Pat. No. 5,454,605, entitled "Tool Joint Connection with Interlocking Wedge Threads", and issued Oct. 3, 1995, to Hydril Company of Houston, Tex., as assignee of the inventor Keith C. Mott.

However, other pin and box end designs may be employed.

Grooves 912, 915, best shown in FIG. 9B–FIG. 9C, are provided in the respective tool joint 118 as a means for housing electromagnetic couplers 916, each comprising a pair of toroidal cores 918, 921 having magnetic permeability about which a radial or Archimedean coil (not shown) is wound. The groove 915 is recessed into the secondary shoulder, or face, 942 of the pin end 906. The groove 912 is recessed into the internal shoulder 945. Additional information regarding the pin and box ends 906, 909, their manufacture, and placement is disclosed in:

- the aforementioned U.S. Pat. No. 6,670,880;
- U.S. application Ser. No. 10/605,484, entitled "Tool Joints Adapted for Electrical Transmission," and filed Oct. 2, 2003, in the name of David R. Hall, et al.;

In the illustrated embodiment, the grooves 915, 912 are located so as to lie equidistant between the inner and outer diameter of the face 942 and the shoulder 945. Further, in this orientation, the grooves 915, 912 are located so as to be substantially aligned as the joint 118 is made up.

Figure 10A:
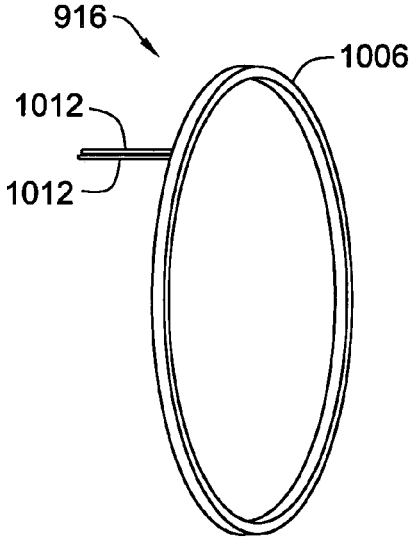
FIG. 10A–FIG. 10B illustrate an electromagnetic coupler of the section in FIG. 9A–FIG. 9C in assembled and exploded views, respectively, that form an electromagnetic coupling in the joint of FIG. 8A–FIG. 8B.
Figure 10B:
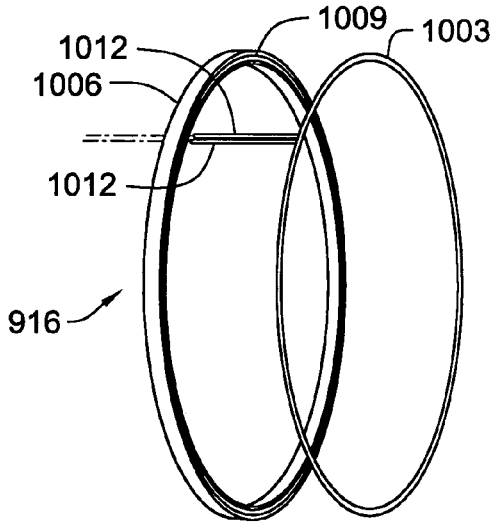

FIG. 10A–FIG. 10B illustrate an electromagnetic coupler 916 in assembled and exploded views, respectively. Additional information regarding the construction and operation of the electromagnetic coupler 916 in various alternative embodiments are disclosed in:

- the aforementioned U.S. Pat. 6,670,880;
- U.S. application Ser. No. 10/430,734, entitled "Loaded Transducer for Downhole Drilling components," and filed May 6, 2003, in the name of David R. Hall, et al.;
- U.S. application Ser. No. 10/612,255, entitled "Transmission Elements for Downhole Drilling Components," and filed Jul. 2, 2003, in the name of David R. Hall, et al.;
- U.S. application Ser. No. 10/653,564, entitled "Polished Downhole Transducer Having Improved Signal Coupling," and filed Sep. 2, 2003, in the name of David R. Hall, et al.; and
- U.S. application Ser. No. 10/605,493, entitled "Improved Electrical Contacts For Downhole Drilling Networks," and filed Oct. 2, 2003, in the name of David R. Hall, et al.;

Parts of these references are excerpted below with respect to this particular embodiment of the electromagnetic couplers 916.

As previously mentioned, the electromagnetic coupler 916 consists of an Archimedean coil, or planar, radially wound, annular coil 1003, inserted into a core 1006. The laminated and tape wound, or solid, core 1006 may be a metal or metal tape material having magnetic permeability, such as ferromagnetic materials, irons, powdered irons, ferrites, or composite ceramics, or a combination thereof. In some embodiments, the core material may even be a material without magnetic permeability such as a polymer, like polyvinyl chloride ("PVC"). More particularly, in the illustrated embodiment, the core 1006 comprises a magnetically conducting, electrically insulating ("MCEI") element. The annular coils 1003 may also be wound axially within the core material and may consist of one or more than one layers of coils 1003.

As can best be seen in the cross section in FIG. 10B, the core 1006 includes a U-shaped trough 1009. The dimensions of the core 1006 and the trough 1009 can be varied based on the following factors. First, the core 1006 must be sized to fit within the grooves 912, 915. In addition, the height and width of the trough 1009 should be selected to optimize the magnetically conducting properties of the core 1006. Lying within the trough 1009 of the core 1006 is an electrically conductive coil 1003. This coil 1003 comprises at least one loop of an insulated wire (not otherwise shown), typically only a single loop. The wire may be copper and insulated with varnish, enamel, or a polymer. A tough, flexible polymer such as high density polyethylene or polymerized tetrafluoroethane ("PTFE") is particularly suitable for an insulator. The specific properties of the wire and the number of loops strongly influence the impedance of the coil 1003.

The coil 1003 is preferably embedded within a material (not shown) filling the trough 1009 of the core 1006. The material should be electrically insulating and resilient, the resilience adding further toughness to the core 1006. Standard commercial grade epoxies combined with a ceramic filler material, such as aluminum oxide, in proportions of about 50/50 percent suffice. The core 1006 is, in turn, embedded in a material (not shown) filling the groove 912 or 915. This second embedment material holds the core 1006 in place and forms a transition layer between the core 1006 and the steel of the pipe to protect the core 1006 from some of the forces seen by the steel during joint makeup and drilling. This resilient, embedment material may be a flexible polymer, such as a two-part, heat-curable, aircraft grade urethane. Voids or air pockets should also be avoided in this second embedment material, e.g., by centrifuging at between 2500 to 5000 rpm for about 0.5 to 3 minutes.

Returning to FIG. 9B–FIG. 9C, a rounded passsage 924 is formed within the downhole component for conveying an insulated electrical conductor 948 along the section 112. The electrical conductor 948 is attached within the groove 924 and shielded from the abrasive drilling fluid. The electrical conductor 948 may consist of wire strands or a coaxial cable. The conductor means 948 is mechanically attached to each of the toroidal cores 918, 921. When installed into the grooves 912, 915, the electromagnetic couplers 916 are potted in with an abrasion resistant material in order to protect them from drilling fluids (not shown).

An electrical conductor 948, shown in FIG. 9B–FIG. 9C, is connected between the coils 1003 at the box and pin ends 906, 909 of the section 112. The electrical conductor 948 is, in the illustrated embodiment, a coaxial cable with a characteristic impedance in the range of about 30 Ω–120 Ω, e.g., in the range of about 50 Ω–75 Ω. In the illustrated embodiment, the electrical conductor 948 has a diameter of about 0.25" or larger. Various aspects of suitable coaxial cables and their retention in and connection to other elements of the transmission path in various alternative embodiments are disclosed in:

- U.S. Application Ser. No. 10/605,373, entitled "Load-Resistant Coaxial Transmission Line," and filed Sep. 25, 2003, in the name of David R. Hall, et al.
- U.S. application Ser. No. 10/456,104, entitled "Electrical Transmission Line Diametrical Retention Mechanism," and filed Jun. 9, 2003, in the name of David R. Hall, et al.
- U.S. application Ser. No. 10/358,099, entitled "Data Transmission System For a Downhole Component," and filed Feb. 2, 2003, in the name of David R. Hall, et al.
- U.S. application Ser. No. 10/212,187, entitled "An Expandable Metal Liner for Downhole Components," and filed Aug. 5, 2002, in the name of David R. Hall, et al.
- U.S. application Ser. No. 10/427,522, entitled "Data Transmission System for a Downhole Component," and filed Apr. 30, 2003, in the name of David R. Hall, et al.
- U.S. application Ser. No. 10/640,956, entitled "An Internal Coaxial Cable Seal System," and filed Aug. 14, 2003, in the name of David R. Hall, et al.;
- U.S. application Ser. No. 10/605,863, entitled "Improved Drill string Transmission Line," and filed Oct. 31, 2003, in the name of David R. Hall, et al.;
- U.S. application Ser. No. 10/653,604, entitled "Drilling Jar for Use in a Downhole Network," and filed Sep. 2, 2003 in the name of David R. Hall, et al.;
- U.S. application Ser. No. 10/707,232, entitled "Seal for Coaxial Cable," and filed Nov. 28, 2003, in the name of David R. Hall, et al.; and
- U.S. application Ser. No. 10/707,673, entitled "Apparatus and Method for Bonding a Transmission Line to a Downhole Tool," and filed Dec. 31, 2003, in the name of David R. Hall, et al.

However, other conductors (e.g., twisted wire pairs) may be employed in alternative embodiments.

The conductor loop represented by the coils 1003 and the electrical conductor 948 is preferably completely sealed and insulated from the pipe of the section 112. The shield (not otherwise shown) should provide close to 100% coverage, and the core insulation should be made of a fully-dense polymer having low dielectric loss, e.g., from the family of polytetrafluoroethylene ("PTFE") resins, Dupont's Teflon® being one example. The insulating material (not otherwise shown) surrounding the shield should have high temperature resistance, high resistance to brine and chemicals used in drilling muds. PTFE is again preferred, or a linear aromatic, semi-crystalline, polyetheretherketone thermoplastic polymer manufactured by Victrex PLC under the trademark PEEK®. The electrical conductor 948 is also coated with, for example, a polymeric material selected from the group consisting of natural or synthetic rubbers, epoxies, or urethanes, to provide additional protection for the electrical conductor 948.

Referring now to FIG. 9A and FIG. 8A, as was mentioned above, the coil 1003 of the illustrated embodiment extends through the core 1006 to meet the electrical conductor 948 at a point behind the core 1006. Typically, the input leads 1012 extend through not only the core 1006, but also holes (not shown) drilled in the grooves 915, 912 through the enlarged walls of the pin end 906 and box end 909, respectively, so that the holes open into the central bore 954 of the pipe section 112. The diameter of the hole will be determined by the thickness available in the section 112 and the input leads 1012. For reasons of structural integrity it is preferably less than about one half of the wall thickness, with the holes typically having a diameter of about between 3 mm and 7 mm. The input leads 1012 may be sealed in the holes by, for example, urethane. The input leads 1012 are soldered to the electrical conductor 948 to affect the electrical connection therebetween.

Returning to FIG. 8A and FIG. 9A–C, a pin end 906 of a first section 112 is shown mechanically attached to the box end 909 of a second section 112 by means of the mating threads 936, 939. The sections 112 are screwed together until the external shoulders 930, 951 are compressed together forming the primary seal for the joint 118 that prevents the loss of drilling fluid and bore pressure during drilling. When the joint 118 is made up, it is preloaded to approximately one half of the torsional yield strength of the pipe itself. The preload is dependent on the wall thickness and diameter of the pipe, and may be as high as 70,000 foot-pounds. The grooves 912, 915 should have rounded corners to reduce stress concentrations in the wall of the pipe.

When the pin and box ends 906, 909 of two sections 112 are joined, the electromagnetic coupler 916 of the pin end 906 and the electromagnetic coupler 916 of the box end 909 are brought to at least close proximity. The coils 1003 of the electromagnetic couplers 916, when energized, each produces a magnetic field that is focused toward the other due to the magnetic permeability of the core material. When the coils are in close proximity, they share their magnetic fields, resulting in electromagnetic coupling across the joint 118. Although is not necessary for the electromagnetic couplers 916 to contact each other for the coupling to occur, closer proximity yields a stronger coupling effect.

Figure 11:
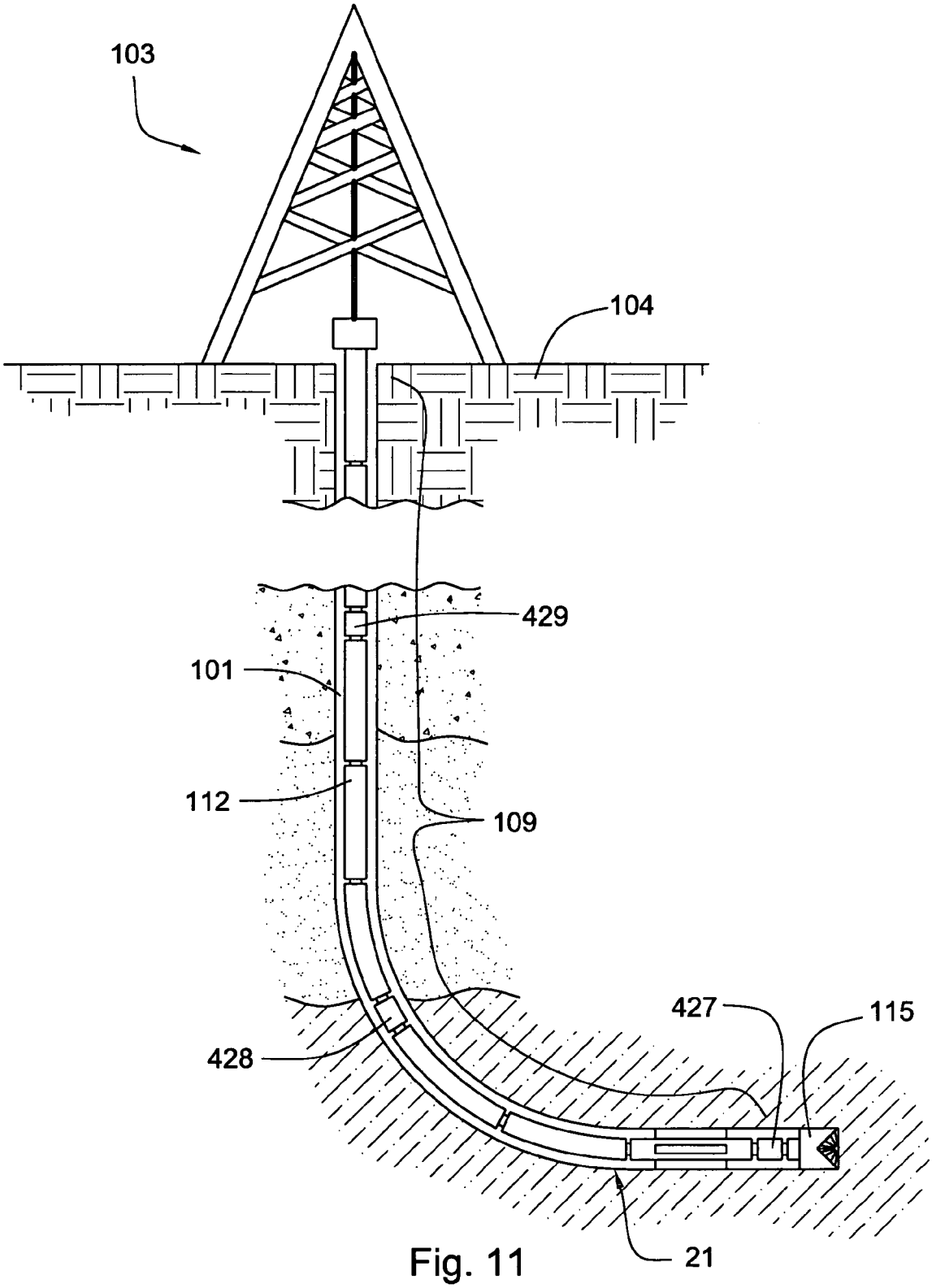
FIG. 11 is a cross-sectional view illustrating one embodiment of a drill rig in accordance with the invention showing a directional drilling application where the drill string is steered from a vertical path.

Referring to FIG. 11, in selected applications, a drill string 109 may be intentionally directed or steered away from a vertical path. This process of steering the drill sting 109 is known as directional drilling. Directional drilling may provide various advantages compared to conventional vertical drilling. For example, a drill operator may wish to target several different reservoirs from a single drill rig location. By steering the drill bit 115 in a desired direction, a reservoir may be targeted that is not directly beneath the drill rig 103. In addition, some reservoirs may be more effectively tapped by penetrating them horizontally rather than vertically. Various downhole tools, such as hydraulic motors, whipstocks, jetting, and the like, may be used to effectively steer a drill bit 115 in a desired direction.

Although directional drilling may be advantageous in some situations, some problems may result from the non-vertical orientation of the drill string 109. For example, cuttings removed by the drill bit 115 may undesirably settle towards the bottom 21 of the borehole 101. This may obstruct the flow of drilling fluid and increase the probability of a stuck pipe. In underbalanced applications, this problem is worsened due to the reduced pressure of the drilling fluid.

In accordance with the invention, sensors 427–429, such as pressure sensors 427–429, may be spaced at intervals along the drill string 109 to monitor the pressure or other rheological property of the drilling fluid. As described in the description of FIGS. 1 through 11, measurements from these sensors 427–429 may be relayed to the surface through a communications network integrated into the drill string 109. Embodiments of the communications network and variations thereof are disclosed in U.S. Pat. No. 6,670,880, incorporated herein by this reference, and in U.S. application Ser. Nos. 09/909,469 and 10/358,099, both of which are incorporated herein by these references. If there is an irregular pressure or other rheological deviation detected by any of the sensors 18*a*–*c*, this may signify that cuttings or other objects may be accumulating inside the annulus, thereby increasing the probability of a stuck pipe. In such situations, remedial measures, such as increasing the flow rate, viscosity, or pressure of the drilling fluid, jarring the drill string, or the like, may be conducted to prevent the occurrence of a stuck pipe.

In other embodiments, properties or states of the drill string 109 such as torque, strain, bending, vibration, rotation, azimuth, and inclination, flow data of the drilling fluid, or a combination thereof, may also be measured along with pressure or rheological readings from the sensors 427–429 to detect cutting accumulations or the like. For example, if the torque required to rotate the drill string 109 increases simultaneously with pressure deviations measured by the sensors 427–429, this may indicate that cuttings are accumulating at some point in the borehole 101. Likewise, if the flow of drilling fluid slows simultaneously with pressure deviations measured by the sensors 427–429, this may indicate that cuttings are accumulating in the borehole 101.

Figure 12:
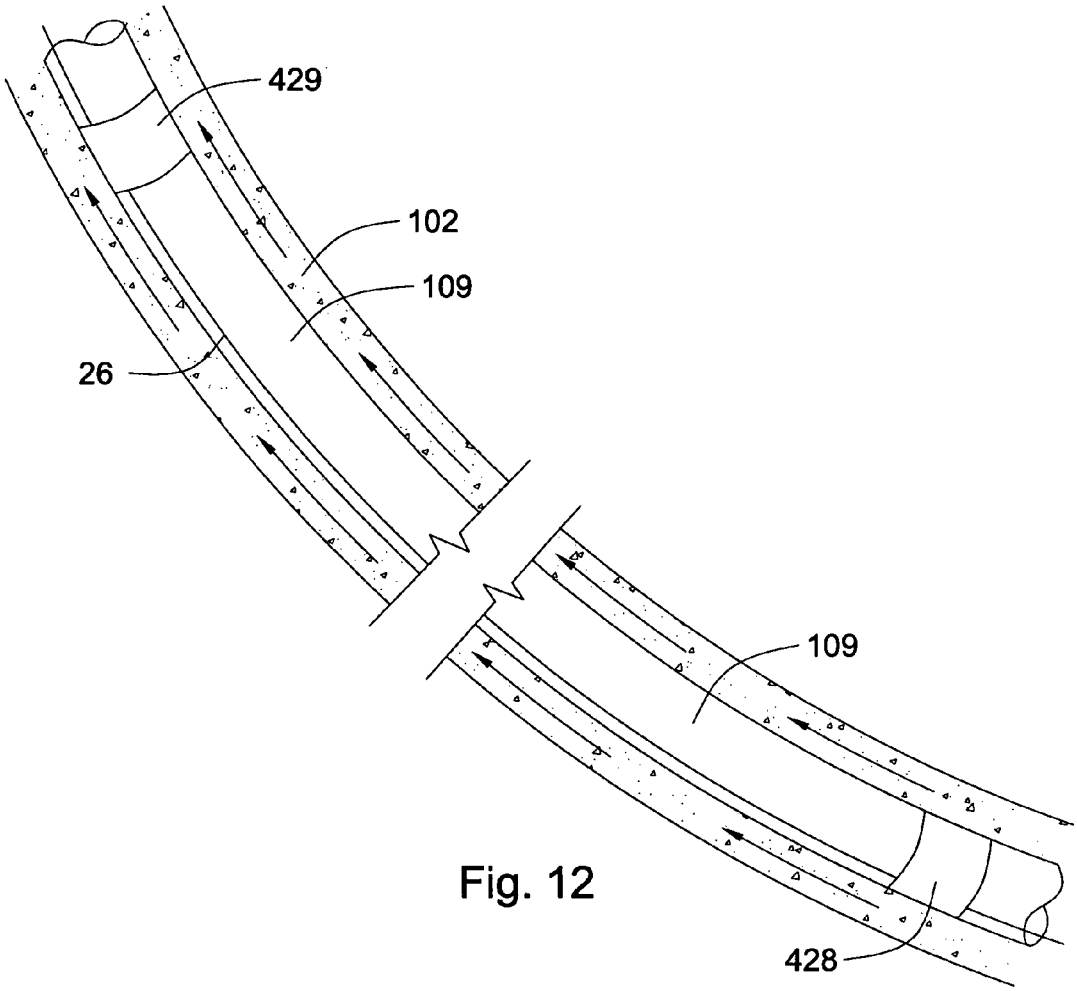
FIG. 12 is a cross-sectional view illustrating one embodiment of drilling fluids carrying cuttings through the annulus of a borehole.

Referring to FIG. 12, under normal operating conditions, a drilling fluid flows towards the surface through the annulus 102 while maintaining cuttings in a suspended state. In certain drilling fluids, when the flow is stopped, the drilling fluid may gel or partially solidify to keep the cuttings from settling to the bottom of the borehole. When the flow is restarted, the movement causes the viscosity of the drilling fluid to diminish so the drilling fluid may continue transporting cuttings to the surface. When the system is functioning properly, cuttings are removed at a sufficient rate to avoid accumulations that may cause a stuck pipe or some other problem.

As illustrated, one or several sensors 428, 429, may be installed at selected locations along the drill string 109 to monitor the pressure of drilling fluids traveling through the annulus 102. Measurements from the pressure sensors 428, 429 may be transmitted from the sensors 428, 429 to the surface along a transmission line 26 routed through the drill string 109. If cuttings begin to accumulate at a point between or near the pressure sensors 428, 429, the change in pressure may be detected in real time at the surface so remedial measures may be taken. Although the sensors 428, 429 are described here as pressure sensors 428, 429, in other embodiments, the sensors 428, 429 may sense some other rheological property or state of the drilling fluid, such as temperature, viscosity, flow rate, shear rate, or the like, to properly monitor the drilling fluid. In other embodiments, the sensors 428, 429 may sense some property or state of the borehole 101 or natural formation (not shown) such as gamma ray readings.

Figure 13:
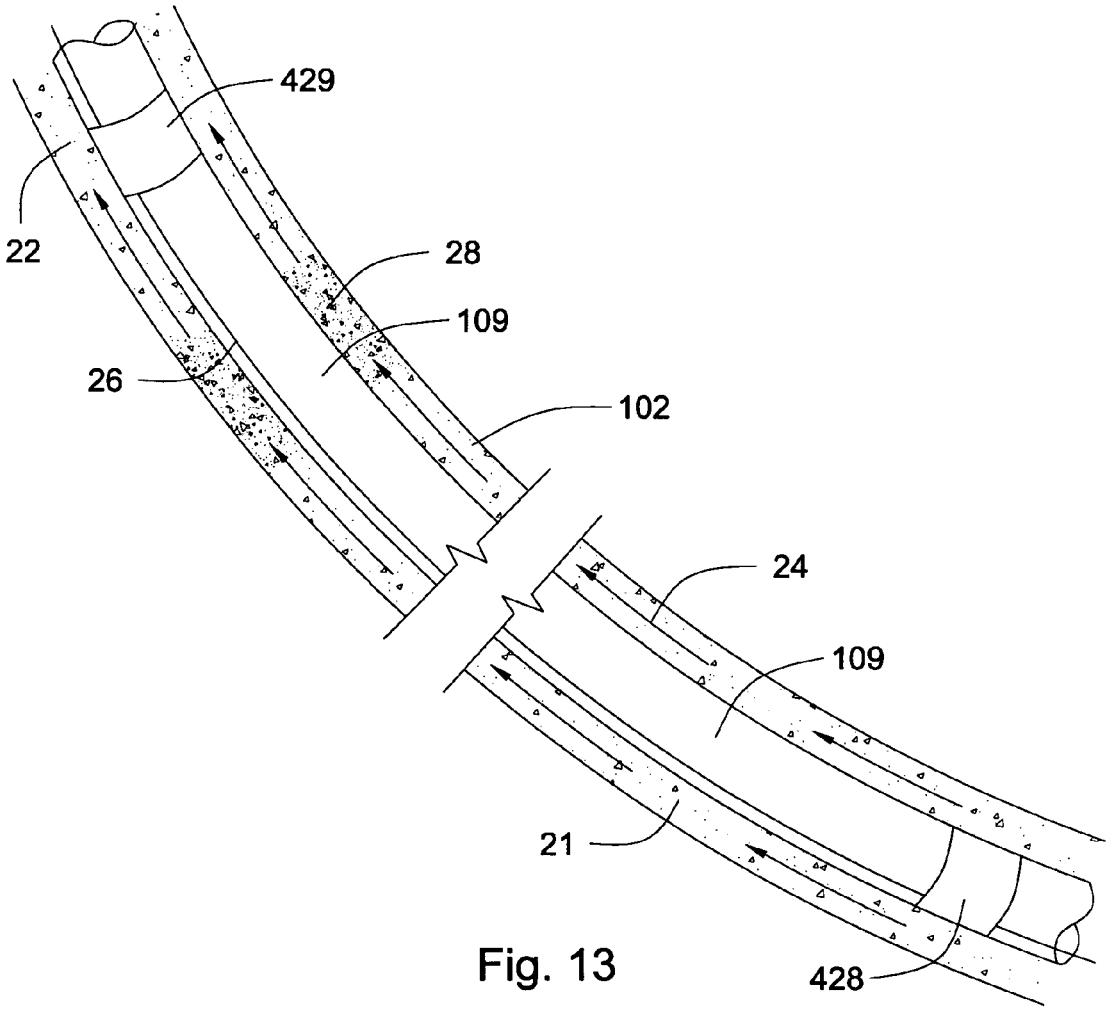
FIG. 13 is a cross-sectional view illustrating one embodiment of cuttings or other substances accumulating or packing themselves in one area of the annulus of a borehole and blocking the flow of drilling fluid.

Referring to FIG. 13, for example, in certain situations, cuttings may begin to form an accumulation 28 or block the annulus 102, causing a blockage. This may cause the pressure of the drilling fluid to decrease above the accumulation 28 and increase below the accumulation 28 since the fluid is forced in an upward direction 24. Thus, the fluid pressure measured by the sensor 429 may decrease, while the fluid pressure measured by the sensor 428 may increase. At the surface, this deviation detected by the sensors 428, 429 may not only signal that an accumulation 28 has occurred, but may also indicate the approximate location of the accumulation 28. Thus, appropriate remedial measures may be taken to remove or reduce the accumulation 28 before differential sticking or a stuck pipe occurs.

Figure 14:
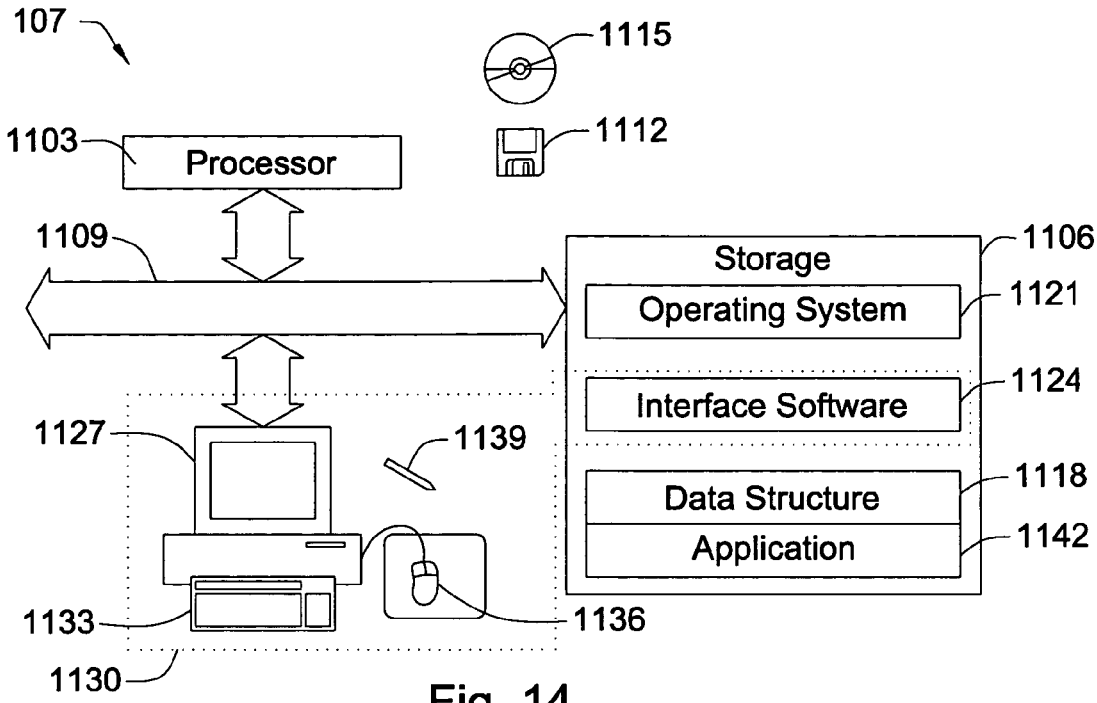
FIG. 14 is a block diagram of selected portions of the computing apparatus of FIG. 1 located at the surface.

FIG. 14 depicts, in a block diagram, selected portions of the computing apparatus 107, including a processor 1103 communicating with storage 1106 over a bus system 1109. In general, the computing apparatus 107 will handle a fair amount of data and, thus, certain types of processors are more desirable than others for implementing the processor 1105. For instance, a digital signal processor ("DSP") may be more desirable for the illustrated embodiment than will be a general purpose microprocessor. In some embodiments, the processor 1105 may be implemented as a processor set, such as a microprocessor with a graphics co-processor.

The storage 1106 may be implemented in conventional fashion and may include a variety of types of storage, such as a hard disk and/or RAM and/or removable storage such as is the magnetic disk 1112 and the optical disk 1115. The storage 1106 will typically involve both read-only and writable memory implemented in disk storage and/or cache. Parts of the storage 1106 will typically be implemented in magnetic media (e.g., magnetic tape or magnetic disk) while other parts may be implemented in optical media (e.g., optical disk). The present invention admits wide latitude in implementation of the storage 1106 in various embodiments.

The storage 1106 is encoded with one or more data structures 1118 employed in the present invention as discussed more fully below. The storage 1106 is also encoded with an operating system 1121 and some interface software 1124 that, in conjunction with the display 1127, constitute an operator interface 1130. The display 1127 may be a touch screen allowing the operator to input directly into the computing apparatus 107. However, the operator interface 1130 may include peripheral I/O devices such as the keyboard 1133, the mouse 1136, or the stylus 1139. The processor 1103 runs under the control of the operating system 1121, which may be practically any operating system known in the art. The processor 1103, under the control of the operating system 1121, invokes the interface software 1124 on startup so that the operator can control the computing apparatus 107.

However, the storage 1106 is also encoded with an application 1142 in accordance with the present invention.

The application 1142 is invoked by the processor 1103 under the control of the operating system 1121 or by the user through the operator interface 1130. The user interacts with the application 1142 through the user interface 1130 to input information on which the application 1142 acts to assess the down-hole drilling conditions.

Thus, the apparatus of the invention comprises, in the illustrated embodiment:

- a drill string 109, shown in FIG. 1;
- a plurality of sensors 426, shown in FIG. 4–FIG. 5, distributed along the length of the drill string 109 and capable of sensing localized down-hole conditions while drilling as shown in FIG. 12–FIG. 13;
- a computing device, i.e., the processor 1103, shown in FIG. 14, of the computing apparatus 107, capable of analyzing the data 312, shown in FIG. 3, output by the sensors and representative of the sensed localized conditions to assess the down-hole drilling conditions; and
- a down-hole network 200, shown in FIG. 2, over which the data 312 may be transmitted from the sensors 426 to the computing device 1103.

Note, however, that invention admits variation in the implementation of the apparatus and that the illustrated embodiment is but one of several within the scope of the claims set forth below.

Returning to FIG. 1, in operation of the apparatus, the drill string 109 is tripped into the borehole 101. As the drill string 109 drills deeper into the earth 102, additional sections 112 are added to the drills string by mating new sections 112 to the existing drill string 109 as discussed relative to FIG. 8A. At predetermined intervals, approximately 1,000'–5,000' in the illustrated embodiment, the section 112 added to the drill string is a node 121, such as the node 121 shown in FIG. 4–FIG. 5.

During the drilling operations, the down-hole network 200, discussed relative to FIG. 2–FIG. 3 is implemented in the drill string. Proximate to, or in, each node 121, a variety of sensors 426, shown best in FIG. 5, sense localized down-hole conditions. As was mentioned above, this is a feature of the illustrated embodiment, but the invention does not necessarily require that the sensors 426 be located in or proximate to a node 121. The sensors 426 output data representative of the sensed localized conditions that is collected and transmitted up-hole by a node 121 as discussed relative to FIG. 4–FIG. 5 above. The data is transmitted up-hole in packets 212, shown in FIG. 2, having a structure such as the packet 600 shown in FIG. 6. At the surface, the computing device 107 collects the data and stores it in the data structure 1118, shown in FIG. 11, to capture it for analysis.

Referring now to FIG. 14, the application 1142 analyzes the captured data to assess the down-hole drilling conditions. The application 1142 may: run continuously upon power-up of the computing apparatus 107; be triggered by the operating system 1121 periodically upon a predetermined lapse of time; or run upon manual invocation of an operator through the user interface 1130. The results of the analysis may then be presented to the operator through the user interface 1130. The nature of the analysis will be implementation specific, depending on the data available and the conditions of interest.

For instance, consider the drilling condition known as "stuck pipe." The present invention includes appropriate sensors 426, such as strain gauges, down-hole and distributed along the length of the drill string 109. In the illustrated embodiment, the sensors 426 take localized measurements of drilling conditions. The packet 212, shown in FIG. 2, includes the source address 609, shown in FIG. 6, of the node 121 collecting the data from the respective sensor 426. The application 1142 can therefore monitor the localized drilling conditions at the point where the measurement is taken. As the strain on the drill string 109 increases at some point in the borehole 101, the application 1142 can determine not only when a stuck pipe condition begins to evolve, but also where in the borehole 101 it is developing.

Communication of the results of the analysis to the operator can occur at implementation specific times. For instance, if the application 1142, shown in FIG. 11, monitors continuously, the results may be continuously displayed through the user interface 1130. Alternatively, the operator may prompt the application 1142 to display conditions of interest. Or, the application 1142 may display a notice only when some adverse drilling condition is about to occur and corrective or preventative action needs to be taken. Alternative embodiments may also employ varying combinations of these approaches.

Thus, as illustrated in FIG. 15, the method 1200 of the invention comprises, in the illustrated embodiment:

- sensing (at 1203) localized drilling conditions at a plurality of points distributed along the length of a drill string during drilling operations;
- transmitting (at 1206) data representative of the sensed localized conditions to a predetermined location; and
- analyzing (at 1209) the transmitted data to assess the down-hole drilling conditions.

Note, however, that invention admits variation in the implementation of the method and that the illustrated embodiment is but one of several within the scope of the claims set forth below.

For instance, the illustrated embodiment transmits the data up-hole to the computing apparatus 107, shown in FIG. 1, located at the surface 104. However, the "predetermined location" to which the data is transmitted does not necessarily need to be at the surface, or even up-hole from the point at which the localized conditions are sensed. As shown in FIG. 5, each node 121 of the illustrated embodiment includes a processor 406 capable of running applications 406. Each node 121 also includes lines 500, 502 over which it can receive and transmit data from and to other nodes 121 on the down-hole network 200 (shown best in FIG. 2).

Thus, with reference to FIG. 3, the data 312 may be collected at a plurality of points distributed along the length of a drill string 109, and transmitted to a down-hole predetermined location, e.g., the intermediate node $\mathbf{121}_1$. The processor 406 of the intermediate node $\mathbf{121}_1$ might execute an application 504 to analyze the data output by the sensors 426 of that particular node 121 as well as the other nodes 121 on the drill string 109 to assess the down-hole drilling conditions. Note that, in such an embodiment, some nodes 121 may transmit data down-hole to the node $\mathbf{121}_1$ while others may transmit data up-hole to the node $\mathbf{121}_1$. However, size, weight, and other constraints imposed by operating down-hole may make this approach less desirable in some applications than the illustrated embodiment.

Alternative embodiments may also distribute the assessment across the down-hole network 200. In the two embodiments disclosed above, the data is analyzed at a central location, i.e., the surface computing apparatus 107 or the intermediate down-hole node $\mathbf{121}_1$. However, since each of the nodes 121 includes a processor 406 capable of running applications 406, as shown in FIG. 5, each node 121 can analyze the data transmitted to it by its respective sensors 426. While this approach preserves the granularity provided by the present invention, it sacrifices the context that may be provided by context of data from other points in the borehole 101. For some conditions, however, this context may not be as useful.

U.S. Pat. No. 6,670,880, entitled "Downhole Data Transmission System," and issued Dec. 30, 2003, in the name of the inventors David R. Hall, et al. is to hereby incorporated herein by reference for all purposes as if expressly set forth verbatim herein.

This concludes the detailed description. The particular embodiments disclosed above are illustrative only, as the invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular embodiments disclosed above may be altered or modified and all such variations are considered within the scope and spirit of the invention. Accordingly, the protection sought herein is as set forth in the claims below.

What is claimed:

1. An apparatus for use in assessing down-hole drilling conditions, comprising:

a drill string;

a plurality of sensors distributed along the length of the drill string and capable of sensing localized down-hole conditions while drilling;

at least one computing device coupled to at least one sensor of the plurality of sensors capable of analyzing data output by the sensors and representative of the sensed localized conditions;

a down-hole network over which the data may be transmitted as packets from the sensors to the computing device; and the downhole network comprises a plurality of nodes which are in communications with each other through a plurality of cables integrated into sections of the drill string and a plurality of transmission elements adapted to transmit the packets across the joints created by the sections.

2. The apparatus of claim 1, wherein the drill string comprises a plurality of sections of drill pipe and down-hole tools.

3. The apparatus of claim 1, wherein the computing device receives input from all of the sensors sufficient to determine and distinguish between an adverse condition at one or more of the points.

4. The apparatus of claim 1, wherein the sensors have at least one of the group comprising pressure sensors, inclinometers, temperature sensors, thermocouplers, accelerometers, imaging devices, seismic devices and strain gauges.

5. The apparatus of claim 1, wherein the at least one computing device is capable of assessing at least one of a stuck pipe condition and poor hole cleaning.

6. The apparatus of claim 1, wherein the at least one computing device comprises a processor.

7. The apparatus of claim 6, wherein the processor comprises a portion of a surface computing apparatus.

8. The apparatus of claim 7, wherein the processor is programmed to process the input received from the sensors and further programmed to provide a warning to an operator of the drill string, the warning comprising information about the type and location of an adverse condition.

9. The apparatus of claim 8 wherein the processor is further programmed to provide a recommendation to the operator.

10. The apparatus of claim 6, wherein the processor comprises a portion of a node of the down-hole network.

11. The apparatus of claim 1, wherein the down-hole network includes:

a plurality of nodes distributed along the length of the drill string and interfacing with the sensors; and a plurality of communications links between the nodes.

12. The apparatus of claim 1, wherein the apparatus is implemented in at least one of an underbalanced drilling application and an overbalanced drilling application.

13. A method for use in assessing down-hole drilling conditions, comprising:

providing a downhole network comprising a plurality of nodes which are in communication with each other through a plurality of cables integrated into sections of the drill string and a plurality of transmission elements adapted to transmit packets across joints created by the sections sensing localized drilling conditions at a plurality of points distributed along the length of a drill string during drilling operations;

transmitting data packets representative of the sensed localized conditions to a predetermined location; and analyzing the transmitted data packets to assess an adverse down-hole drilling condition.

14. The method of claim 13, wherein the step of sensing localized drilling conditions comprises sensing at least one of pressure, temperature, torque, inclination, acceleration, strain, bending, rotation, azimuth, gamma ray, and weight on bit.

15. The method of claim 13, wherein the step of sensing localized drilling conditions at the plurality of points distributed along the length of a drill string comprises sensing localized conditions at or proximate to a plurality of nodes in a down-hole network.

16. The method of claim 13, wherein the step of transmitting data packets to the predetermined location comprises transmitting data up-hole.

17. The method of claim 13, wherein the step of transmitting data packets to the predetermined up-hole location comprises transmitting the data to one of a node on a down-hole network or a computing apparatus at the surface.

18. The method of claim 13, wherein the step of transmitting data packets to the predetermined location comprises transmitting data down-hole.

19. The method of claim 13, wherein the step of transmitting data packets to the predetermined location comprises transmitting data to the surface.

20. The method of claim 13, wherein the step of transmitting data packets to the predetermined location comprises transmitting data to a centralized predetermined location.

21. The method of claim 13, wherein the step of transmitting data packets to the predetermined location comprises transmitting data to a plurality of distributed predetermined locations.

22. The method of claim 13, wherein the step of analyzing the transmitted data packets to assess the adverse down-hole drilling conditions comprises analyzing the entirety of the data.

23. The method of claim 13, wherein the step of analyzing the transmitted data packets to assess the adverse down-hole drilling conditions comprises analyzing a subset of the data.

24. The method of claim 13, wherein the step of analyzing the transmitted data packets to assess the adverse down-hole drilling conditions comprises analyzing the data to assess a stuck pipe condition.

25. The method of claim 24, wherein the step of analyzing data to assess a stuck pipe condition comprises:

measuring the strain on the drill string at a first point along the drill string;

transmitting the strain measurement along a transmission line integrated into the drill string;

receiving the strain measurement at the ground's surface; and analyzing the strain measurement to detect at least one condition relating to a stuck pipe.

26. The method of claim 25, further comprising measuring the strain on the drill string at a second point along the drill string.

27. The method of claim 26, further comprising detecting at least one condition relating to a stuck pipe by comparing the strain difference between the first and second points.

28. The method of claim 13, further comprising a step of communicating the results of the analysis to an operator.

29. The method of claim 28, wherein the step of communicating the results of the analysis comprises at least one step from a group of steps consisting of:

displaying the results continuously;

displaying the results upon being prompted by the operator; and displaying the results when some adverse drilling condition is about to occur and corrective or preventative action needs to be taken.

30. The method of claim 13, wherein the step of analyzing the transmitted data packets to assess the adverse down-hole drilling conditions comprises at least one step from a group of steps consisting of:

analyzing the transmitted data packets continuously;

analyzing the transmitted data packets upon being prompted by the operator; and analyzing the transmitted data packets when some adverse drilling condition is about to occur and corrective or preventative action needs to be taken.

31. The method of claim 13, wherein the step of analyzing the transmitted data to assess the adverse down-hole conditions further comprises:

measuring the pressure of a downhole drilling fluid at a first point along the drill string;

transmitting the pressure measurement along a transmission line integrated into the drill string;

receiving the pressure measurement at the ground's surface; and analyzing the pressure measurement to detect a condition relating to at least one of a blocked pipe and insufficient hole cleaning.

32. The method of claim 31, further comprising measuring the pressure of the downhole drilling fluid at a second point along the drill string.

33. The method of claim 32, further comprising detecting at least one of a stuck pipe and poor hole cleaning by measuring a pressure difference between the first and second points.

* * * * *